US008033652B2

(12) United States Patent
Kurobe

(10) Patent No.: US 8,033,652 B2
(45) Date of Patent: Oct. 11, 2011

(54) LIQUID DISCHARGE HEAD AND RECORDING APPARATUS HAVING THE SAME

(75) Inventor: Ryoichiro Kurobe, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 316 days.

(21) Appl. No.: 12/416,844

(22) Filed: Apr. 1, 2009

(65) Prior Publication Data

US 2009/0244181 A1 Oct. 1, 2009

(30) Foreign Application Priority Data

Apr. 1, 2008 (JP) ..... 2008-095127

(51) Int. Cl.
*B41J 2/05* (2006.01)

(52) U.S. Cl. ..... 347/65

(58) Field of Classification Search ..... 347/40, 347/43–44, 64–66
See application file for complete search history.

(56) References Cited

U.S. PATENT DOCUMENTS

| | | | | |
|---|---|---|---|---|
| 6,722,757 | B2 | 4/2004 | Saito | |
| 6,854,831 | B2 * | 2/2005 | Kubota et al. | 347/65 |
| 7,597,427 | B2 * | 10/2009 | Sugahara | 347/68 |
| 2005/0285904 | A1 | 12/2005 | Toge | |

* cited by examiner

*Primary Examiner* — Lamson D Nguyen
(74) *Attorney, Agent, or Firm* — Canon USA Inc IP Division

(57) ABSTRACT

A liquid discharge head includes a discharge port array having discharge ports for discharging liquid, a liquid chamber for supplying liquid to the discharge port array, and a liquid introduction passage for introducing liquid to the liquid chamber. A vertical cross section of the liquid chamber has an elongated shape. The liquid introduction passage is wider than the liquid chamber in a width direction of the elongated shape. A communicating portion is longer than a width of the liquid chamber and shorter than the liquid chamber, and is projecting from the liquid introduction passage for the liquid chamber. A bottom of the liquid introduction passage is disposed at a lower position than a top of the liquid chamber in the communicating portion, and a distance between the top and the bottom is longer than half of the width of the liquid chamber.

7 Claims, 19 Drawing Sheets

M−M CROSS SECTION

PRESENT INVENTION

COMPARATIVE EXAMPLE A

COMPARATIVE EXAMPLE B

O–O CROSS SECTION

H1001

H1000

LIQUID DISCHARGE HEAD AND RECORDING APPARATUS HAVING THE SAME

BACKGROUND OF THE INVENTION

1. Field of the Invention

The present invention relates to a liquid discharge head that ejects liquid, such as ink, and a recording apparatus having the same.

2. Description of the Related Art

A known example of a liquid discharge head is an inkjet recording head (hereinafter referred to as a recording head). The recording head is provided with a recording element substrate for ejecting liquid such as ink. Recording is performed such that ink held and stored in an ink tank is supplied to the recording element substrate through an ink supply channel.

In a color printer that uses more than one kind of ink, a recording element substrate to which the more than one kind of ink is supplied is mounted to a recording head. As printers are increasingly dropping in price in recent years, efforts are being made to reduce the areas of, particularly, the high-cost recording element substrates.

As shown in FIG. 12, a recording element substrate H1101 has a plurality of discharge port arrays H1108 (one discharge port group corresponding to one ink supply port is defined as one discharge port array) at predetermined intervals. An increase in cost due to an increase in the area of a recording element substrate is prevented by decreasing the distance between the discharge port arrays (between colors). Ink supply ports H1102 are formed in correspondence with the discharge port arrays H1108, respectively.

A flow of ink until it is supplied to ink supply ports formed in a recording element substrate will be described using an example in which a recording head is integrally provided with an ink tank for holding and storing ink. FIG. 14A shows an external view of an ink-tank integral-type recording head disclosed in U.S. Patent Laid-Open No. 2005-0285904, and FIG. 14B shows the internal structure thereof.

As shown in FIG. 14B, an ink-tank integral-type recording head H1000 capable of supplying more than one kind of ink includes a plurality of ink containing portions H2001 to H2003 for holding ink. FIGS. 15A and 15B are sectional views of the recording head H1000, and FIGS. 16A to 16C are diagrams for describing the shape of an ink supply path.

To describe the shape of an ink supply path S01 among ink supply paths S01 to S03 shown in FIG. 16B, FIG. 15A shows a perspective view of a section of an ink tank H1500 cut along the ink supply path S01; FIG. 15B shows an enlarged view of a part XVB of the perspective sectional view. As shown in FIGS. 15A and 15B, ink contained in the ink containing portion H2001 passes through an ink introduction passage H2101 through a filter H1701 and passes through a liquid chamber H2201 to reach the ink supply port H1102. Thus, a plurality of discharge ports is equally supplied with ink from the liquid chambers. As shown in FIG. 16A, "an ink supply path" in this specification indicates a part constituted by "an ink introduction passage" serving as a liquid introduction passage and "a liquid chamber", and the connecting portion between the ink introduction passage and the liquid chamber is referred to as a communicating portion C.

The relationship between the recording element substrate and the ink supply path will be described herein. As described with reference to FIG. 12, the recording element substrate H1101 is provided with the ink supply ports H1102 corresponding to the individual discharge port arrays H1108. FIG. 16B is a diagram showing the ink supply paths S01 to S02 and the recording element substrate H1101 corresponding to the recording head H1000. As shown in FIG. 16B, liquid chambers H2201 to H2203 which are part of the individual ink supply paths S01 to S03 are arranged parallel in correspondence with the individual ink supply ports H1102. Accordingly, as shown in FIG. 16C, the liquid-chamber width W of at least the inner ink supply path S01 is generally set, at about 0.6 to 0.8 mm, in agreement with the width W' of the ink supply port H1102 (see FIG. 12) because the distances between the individual colors are short.

Meanwhile, it is known that ink in ink supply paths or the like contains gas (dissolved gas) dissolved in the ink and external gas that passes through an ink tank formed from polymer or the like. If these gases are turned into bubbles in liquid chambers, the bubbles sometimes remain in the liquid chambers for a long time until the bubbles pass into the ink introduction passages that are wider in the y-direction than the liquid chambers or are sometimes left in the liquid chambers. This is because bubbles hardly move in the liquid chambers because the liquid-chamber width W is small. Thus, if bubbles remain or are left in the liquid chambers for a long time, they can exert a bad influence on recording.

In this case, the bubbles are generally removed by, for example, joining a member called a cap to the discharge-port formed surface of a recording head, and reducing the pressure inside the cap with a pump or the like to apply a sucking force (suction recovery, U.S. Pat. No. 6,722,757).

As described above, it is possible to reduce bubbles remaining in the liquid chambers by suction recovery; however, conventional recording heads need frequent suction recovery, thus posing the problem of wasting ink every suction recovery, so that it cannot be used for recording.

A possible method for solving the problem is to reduce the frequency of suction recovery by increasing the liquid-chamber width W so as to prevent bubbles from staying in the liquid chambers so that the presence of bubbles in the liquid chambers does not easily exert a bad influence on recording. However, as shown in FIG. 16B, the liquid chambers H2201 to H2203 are arranged parallel in correspondence with the ink supply ports H1102, so that the width W (FIG. 16C) of at least the inner liquid chamber H2201 cannot be increased because of the presence of the other liquid chambers H2202 and H2203 on either side. Another possible method is to increase the liquid-chamber width W by increasing the distance between the ink supply ports H1102. This is, however, not desirable, because this increases the area of the recording element substrate, thus increasing the cost.

Meanwhile, a thorough examination on generation and growth of bubbles in liquid chambers showed that bubbles B exhibit the behavior shown in FIGS. 17A to 17F. That is, the bubbles B are generated at the ends of the liquid chambers (FIG. 17A), continue to grow while staying at the ends (FIGS. 17B to 17D), quickly move toward the communicating portion C due to vibrations or the like (FIG. 17E), and at the communication part C, the ink flow is substantially blocked (FIG. 17F). Vibrations are generated when the recording head is mounted or the ink tank is mounted.

A possible method for solving such problems is to increase the x-direction length Cx (FIG. 16A) of the communicating portion C so that the ink flow is not blocked at the communicating portion C. However, as shown in FIGS. 16B and 16C, the inner ink supply path S01 cannot sometimes have sufficient Cx because of limitations due to the positional relationship among the ink supply paths S01 to S03.

SUMMARY OF THE INVENTION

The present invention provides an inkjet recording head capable of stable recording even if bubbles are generated in a liquid chamber.

A liquid discharge head according to an embodiment of the present invention includes a discharge port array, having a plurality of discharge ports configured to discharge liquid; a liquid chamber configured to supply liquid to the discharge port array, wherein a vertical cross section of the liquid chamber has an elongated shape of which a length direction is along the discharge port array, in a state in which the head is mounted to the apparatus; and a liquid introduction passage configured to introduce liquid to the liquid chamber, the liquid introduction passage being wider than the liquid chamber in a width direction of the elongated shape; wherein a communicating portion in which the liquid chamber communicate with the liquid introduction passage is longer than a width of the liquid chamber along the width direction and shorter than the liquid chamber, with respect to the length direction, and is projecting from the liquid introduction passage for the liquid chamber, wherein with respect to a vertical direction in the state, a bottom of the liquid introduction passage is disposed at lower position than a top of the liquid chamber in the communicating portion, and a distance between the top and the bottom is longer than half of the width of the liquid chamber.

With the configuration of the present invention, bubbles can easily communicate through the communicating portion between the liquid introduction passage and the liquid chamber, so that the bubbles can easily move from the liquid chamber to the liquid introduction passage. Accordingly, a liquid discharge head can be provided in which the influence of the bubbles in the liquid chamber on recording can be reduced so that stable recording can be performed.

Further features of the present invention will become apparent from the following description of exemplary embodiments (with reference to the attached drawings).

DESCRIPTION OF THE EMBODIMENTS

The configuration of embodiments of the present invention will be described with reference to the drawings.

FIGS. 10A to 12 are diagrams for describing an inkjet recording head serving as a liquid discharge head according to an embodiment of the present invention. The components thereof will be described hereinbelow with reference to the drawings.

In this specification, "recording" indicates either of forming significant information such as characters and graphics and visualizing either significant or insignificant information so that human beings can visually perceive it. It also broadly includes forming an image, a design, a pattern, etc. on a recording medium and processing a medium.

"A recording medium" includes not only paper used in common recording apparatuses but also ink-acceptable materials, such as cloth, plastic film, a metal plate, glass, ceramic, lumber, and leather.

"Ink" (sometimes referred to as "liquid") should be broadly defined as for the above-described "recording". That is, "ink" includes liquid for use in forming an image, a design, or a pattern or processing a recording medium, or processing ink (for example, solidifying or insolubilizing a coloring material in ink applied to a recording medium). Thus, "ink" in this specification includes all forms of liquid that can be used for printing.

Liquid Discharge Head

A liquid discharge head that can incorporate the present invention is an inkjet recording head (recording head) that uses an electrothermal converter for making liquid, such as ink, cause film boiling in liquid, such as ink, in response to an electrical signal. The electrothermal converter is disposed so as to face an ink discharge port.

Figure 10A:
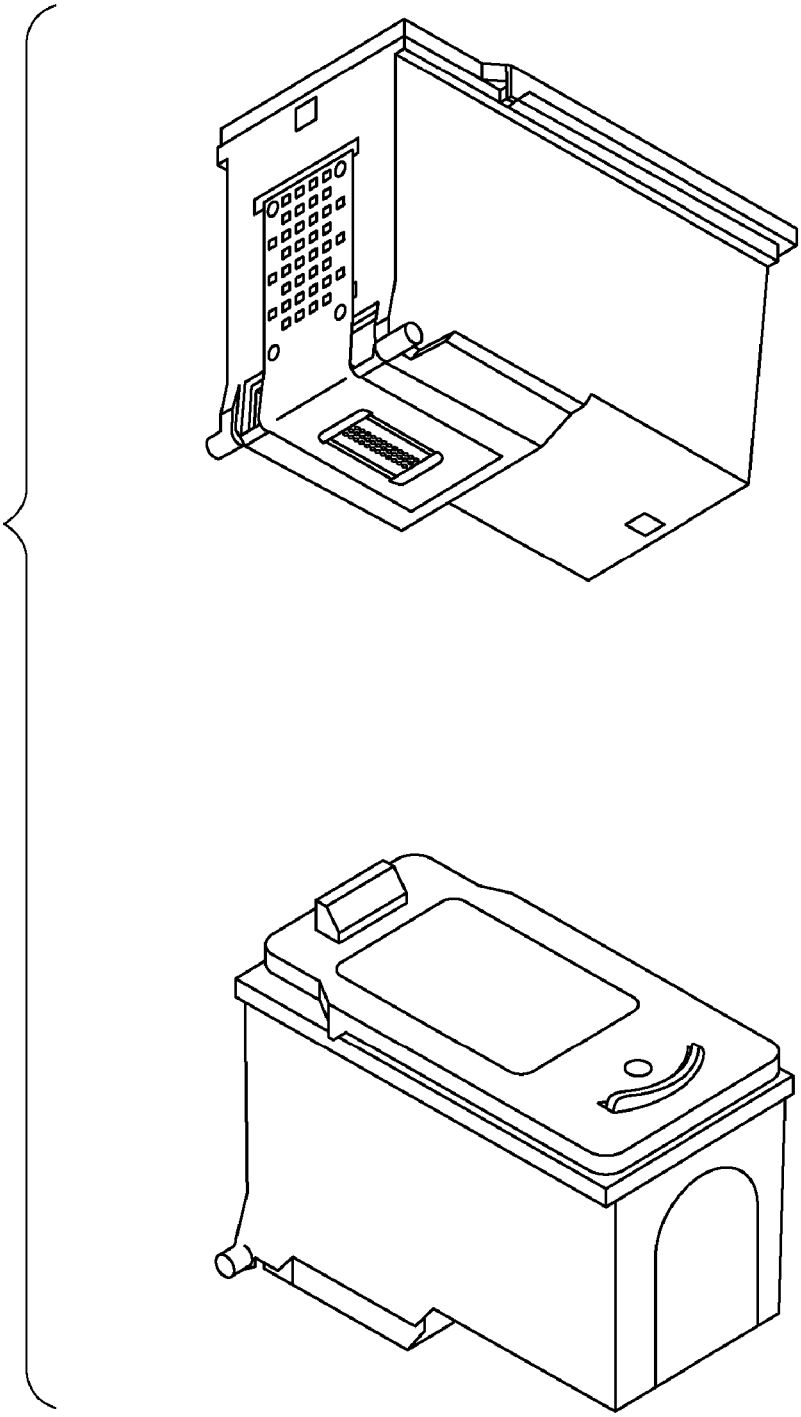
FIGS. 10A and 10B are diagrams showing an inkjet recording head incorporating the ink supply paths of the first and second embodiments of the present invention.
Figure 10B:
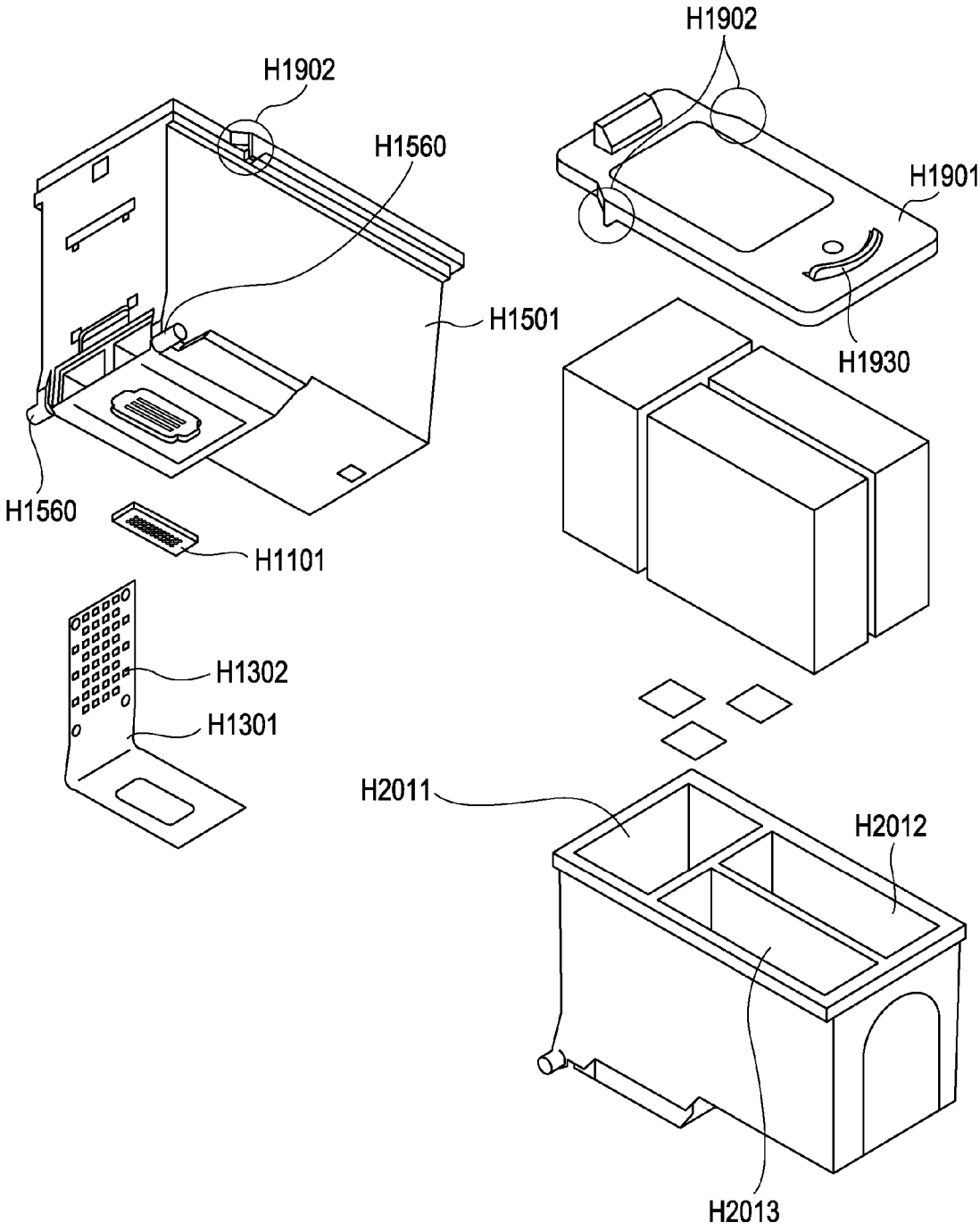

FIG. 10A shows a recording head H1001 that can incorporate the present invention. FIG. 10B shows exploded perspective views of the recording head H1001. The recording head H1001 is of an ink-tank integrated type and has a form that can contain a plurality of kinds of ink, for example, color inks (cyan ink, magenta ink, and yellow ink).

The recording head H1001 is constituted by at least a recording element substrate H1101, an electrical wiring sheet H1301 serving as an electrical wiring member, and an ink tank H1501 serving as an ink holding member.

Figure 11:
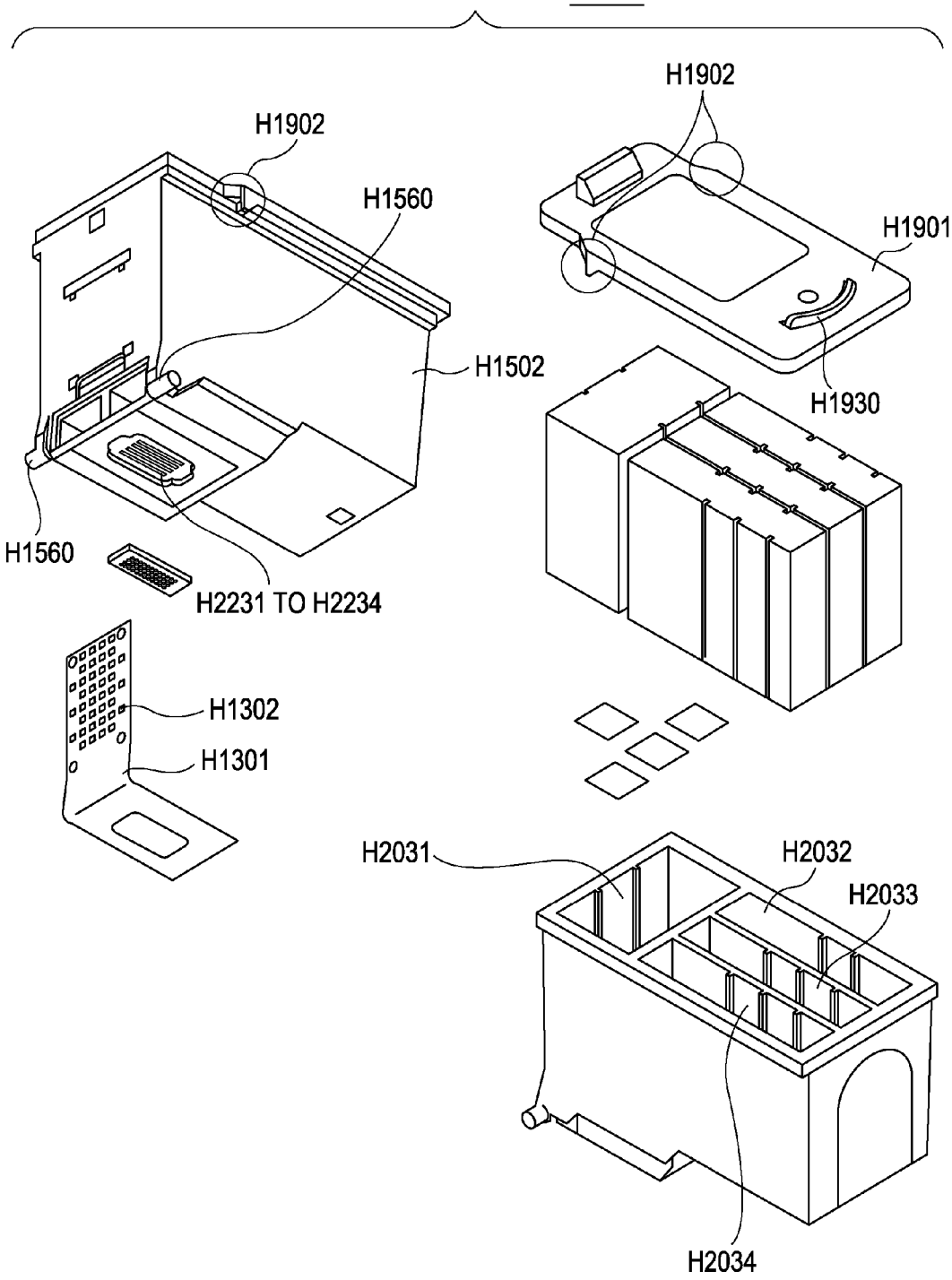
FIG. 11 is a diagram showing an inkjet recording head incorporating the ink supply paths of the third embodiment of the present invention.

Another recording head H1002 that can contain four kinds of ink has the same form as the recording head H1001, except that it has an ink tank H1502 having a different inner configuration therefrom, as shown in exploded perspective views of FIG. 11. Therefore, in FIG. 11, descriptions of components denoted by the same reference numerals as in FIG. 10B will be omitted.

Figure 12:
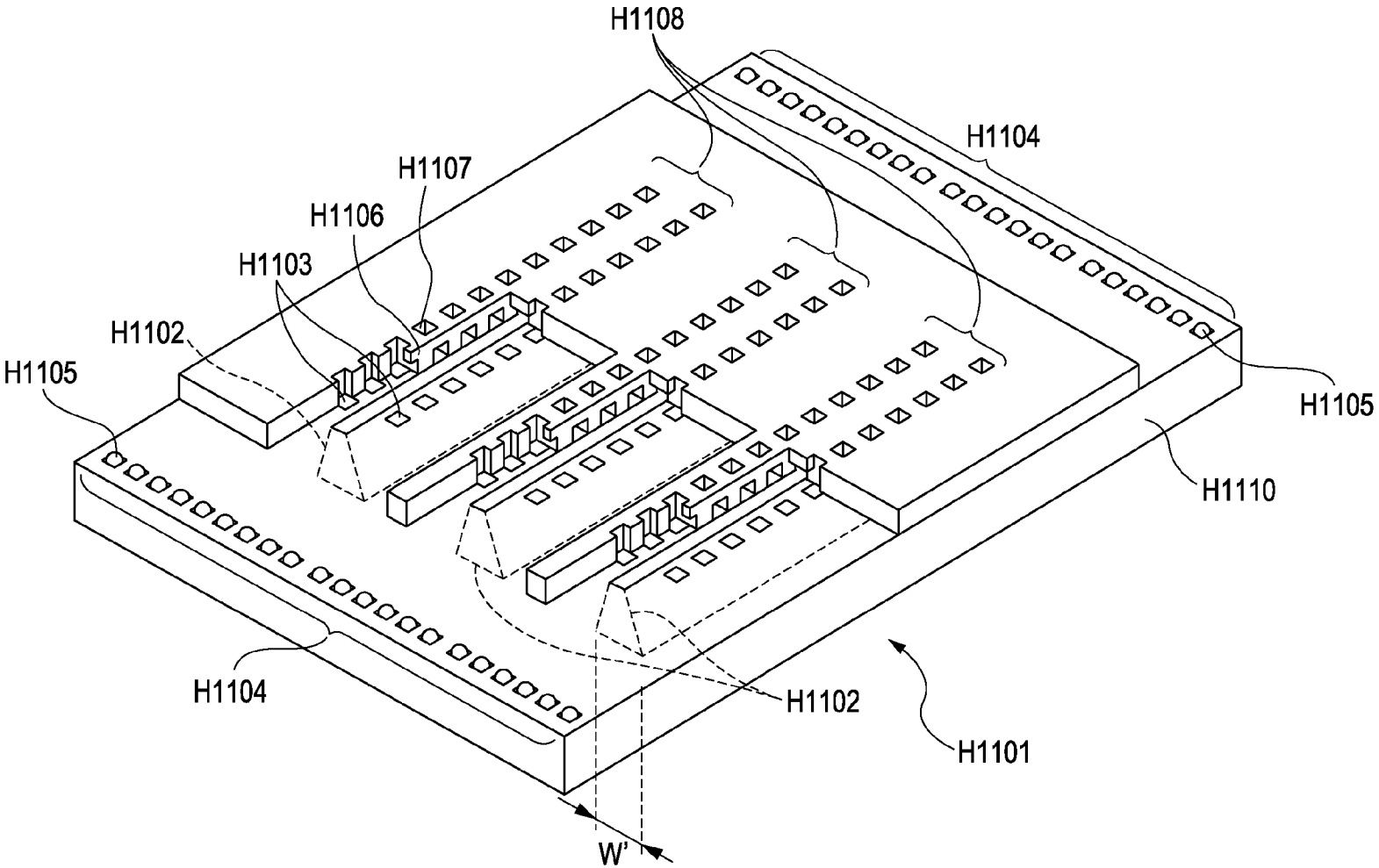
FIG. 12 is a diagram for describing a recording element substrate.

FIG. 12 is a diagram for describing the configuration of the recording element substrate H1101 in fragmentary perspective view. The recording element substrate H1101 is constituted by a silicon substrate H1110 having ink supply ports H1102, electrothermal converters H1103, electric cables, an electrode portion H1104 and so on, and ink channel walls H1106 and discharge ports H1107 formed on the silicon substrate H1110. The ink channel walls H1106 and the discharge ports H1107 are formed of a polymer material on the silicon substrate H1110 by photolithography technology. Bumps H1105 made of gold or the like are formed on the electrode portion H1104 for supplying electrical signals and electricity for driving the electrothermal converters H1103.

As shown in FIG. 12, the recording element substrate H1101 that can eject three kinds of ink has three parallel ink supply ports H1102, for cyan, magenta, and yellow, for example. The electrothermal converters H1103 and the discharge ports H1107 are disposed in line on either side of the individual ink supply ports H1102.

A recording element substrate (not shown) that can eject four kinds of ink has four parallel ink supply ports for cyan, magenta, yellow, and black, for example, like the recording element substrate H1101.

The electrical wiring sheet H1301 shown in FIG. 10B has an electrical-signal path for applying electrical signals for ejecting ink onto the recording element substrate H1101 and is constructed by forming a copper-foil wiring pattern on a polyimide base substrate.

The electrical wiring sheet H1301 further has external-signal input terminals H1302 for receiving electrical signals from a main-body apparatus.

The ink tank H1501 serving as a liquid holding member, shown in FIG. 10B, is formed by molding polymer. For the polymer material, it is preferable to use a polymer material mixed with 5-40% glass filler to improve the rigidity of the ink tank H1501.

The recording element substrate H1101 is bonded in accurate position to the ink tank H1501, at the downstream part of the ink supply paths provided in the ink tank H1501, so as to allow ink to communicate with the ink supply ports H1102 formed in the recording element substrate H1101.

The back surface of part of the electrical wiring sheet H1301 is bonded by an adhesive to the flat surface around the recording element substrate H1101. The electrically connected portion between the recording element substrate H1101 and the electrical wiring sheet H1301 is protected from corrosion due to ink and an external impact by being sealed with a sealant. An unbonded portion of the electrical wiring sheet H1301 is bent and fixed by thermal caulking or with an adhesive or the like to a side surface that is substantially perpendicular to the surface of the ink tank H1501 on which liquid chambers H2211 to H2213 are formed (the surface on which the recording element substrate H1101 is bonded).

A concrete configuration of the ink supply paths for supplying ink from the ink tank H1501 to the recording element substrate H1101 will be described in detail in embodiments, to be described later.

Mechanism of the Present Invention

Before describing concrete embodiments, how bubbles generated in the liquid chambers of the ink supply paths filled with liquid behave in the communicating portions will be described, and thereafter, the mechanism of the present invention will be described with reference to the schematic diagrams. For ease of explanation, a case in which an ink supply path is configured by a cuboid-shaped ink introduction passage and a cuboid-shaped liquid chamber will be described with reference to the configuration of a comparative example.

Figure 13:
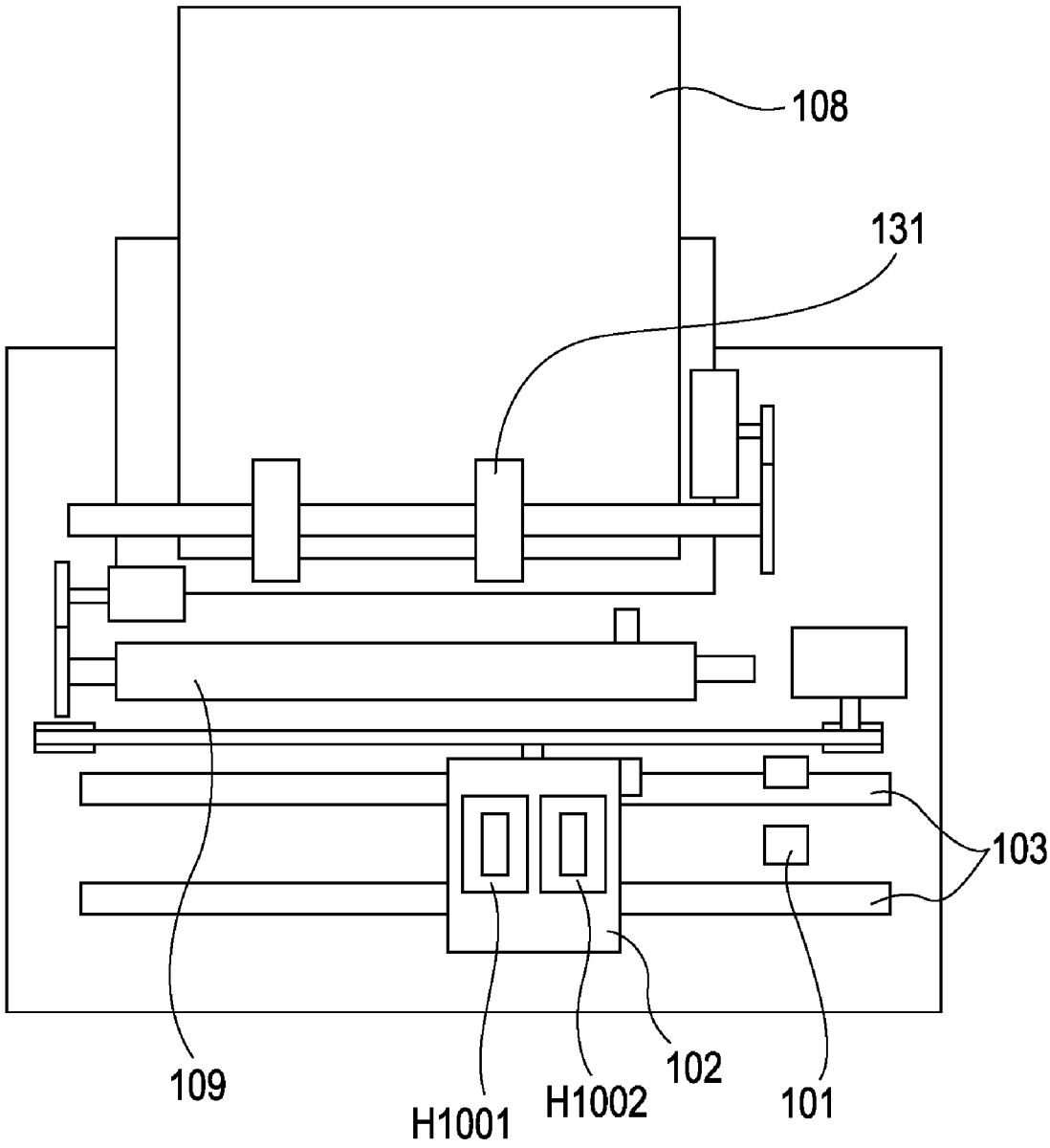
FIG. 13 is a diagram showing an example of an inkjet recording apparatus.
Figure 14A:
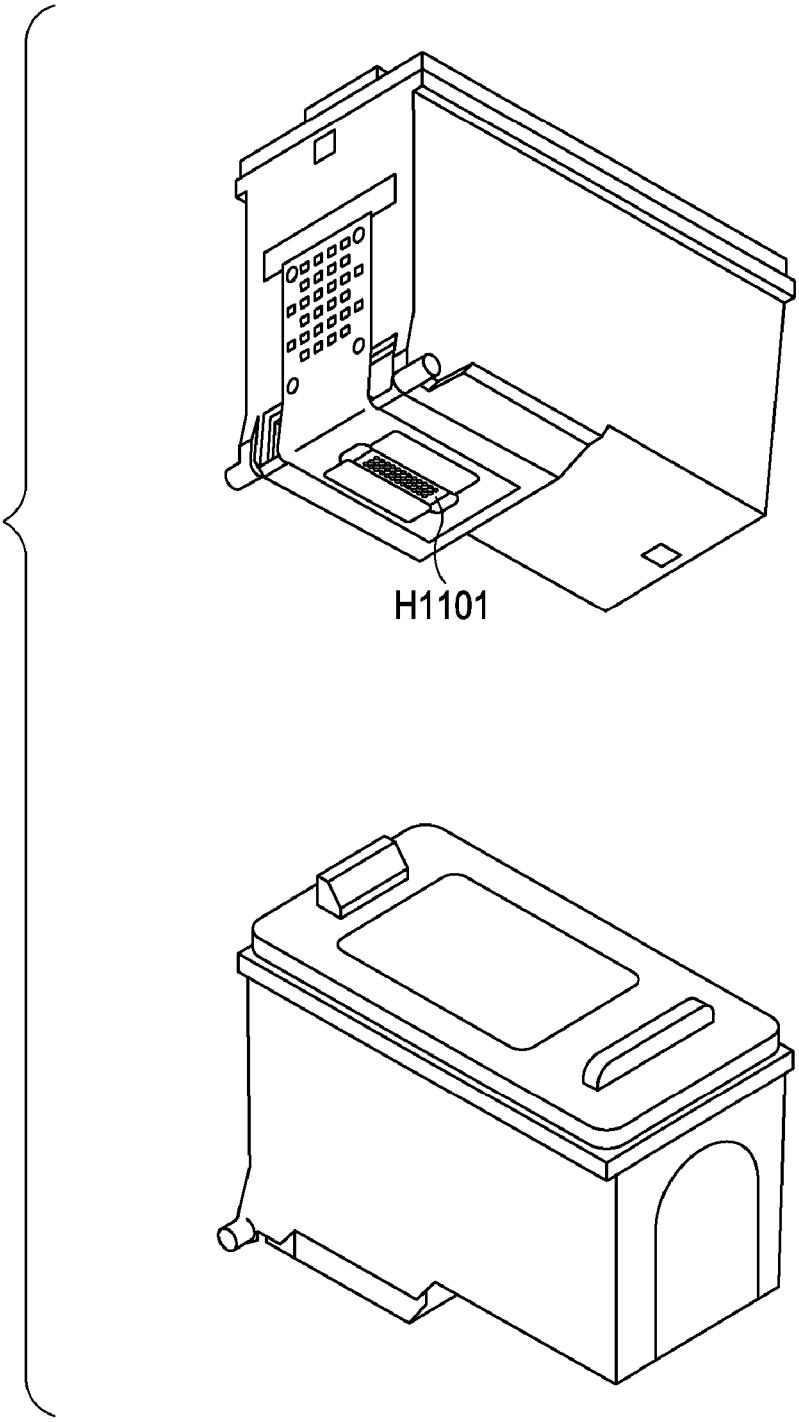
FIGS. 14A and 14B are diagrams for describing a conventional inkjet recording head.
Figure 14B:
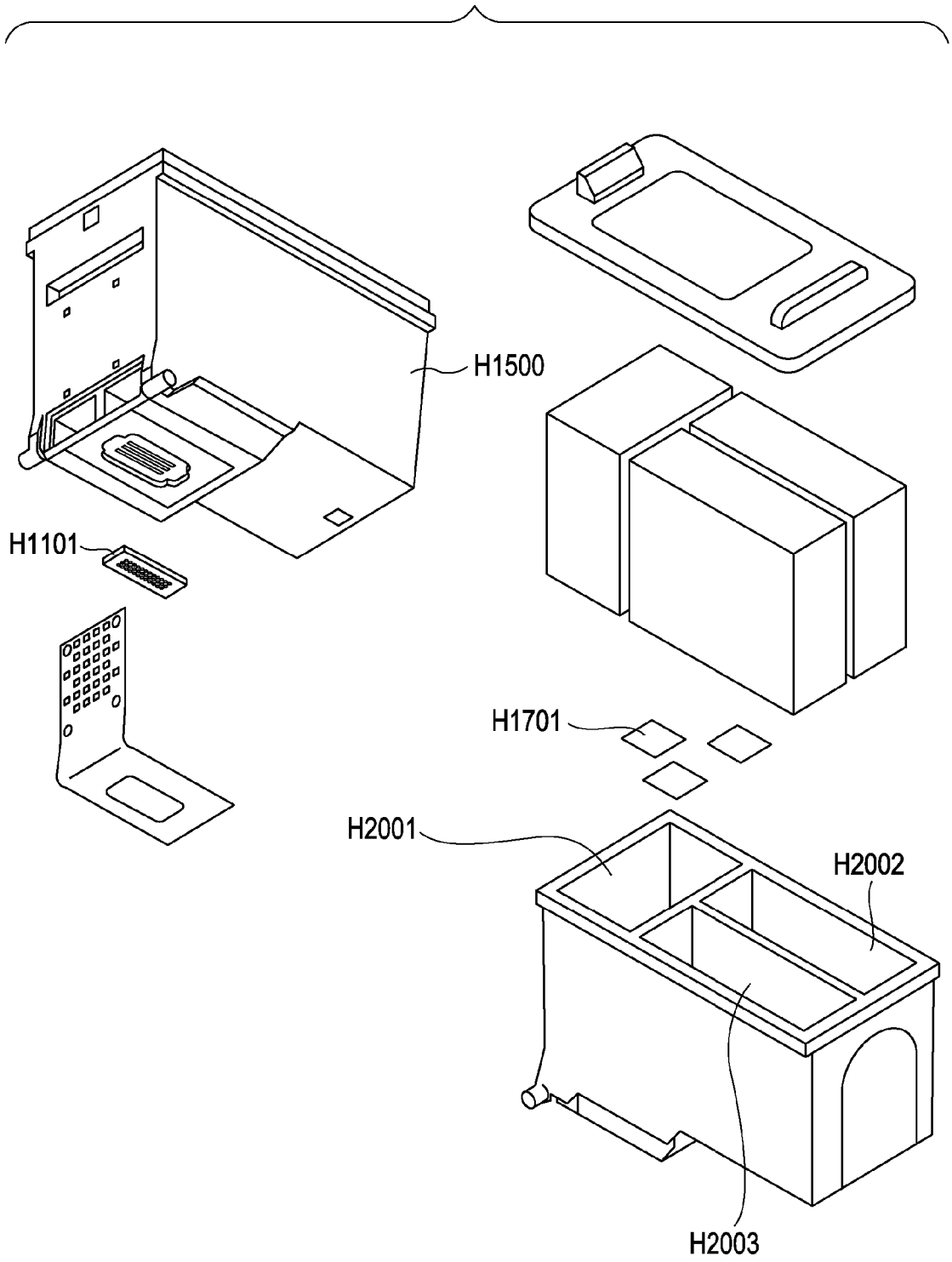
Figure 15A:
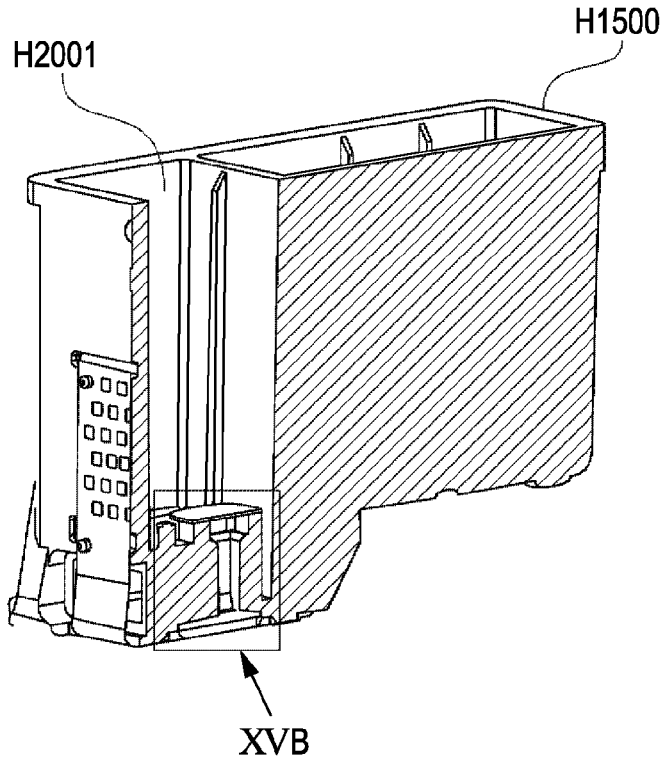
FIG. 15A is a sectional view of a conventional ink tank.
Figure 15B:
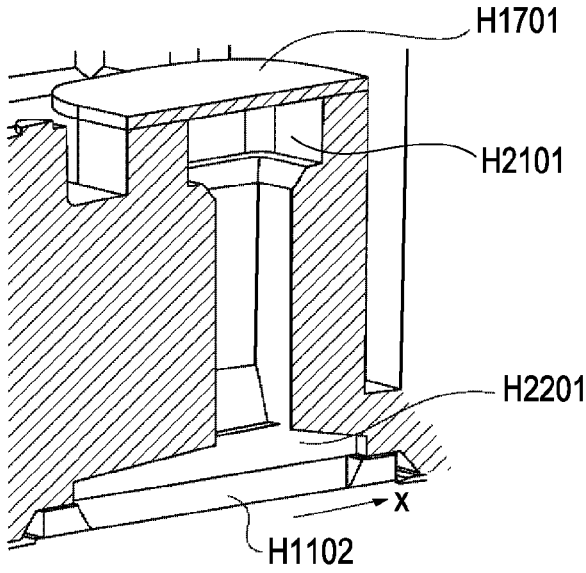
FIG. 15B is an enlarged view of an ink supply path in FIG. 15A.
Figure 16A:
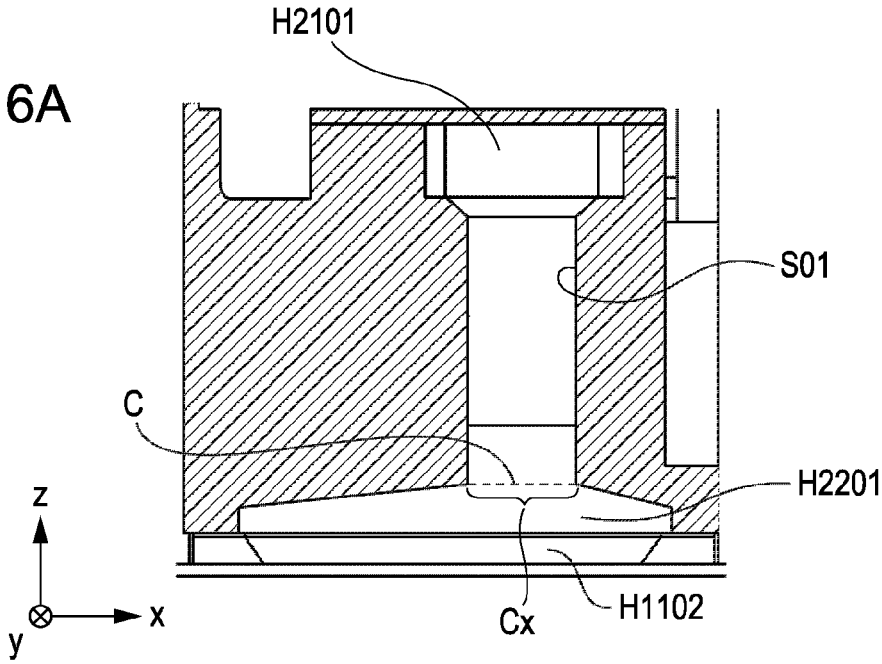
FIGS. 16A through 16C are diagrams for describing ink supply paths in a conventional ink tank.
Figure 16B:
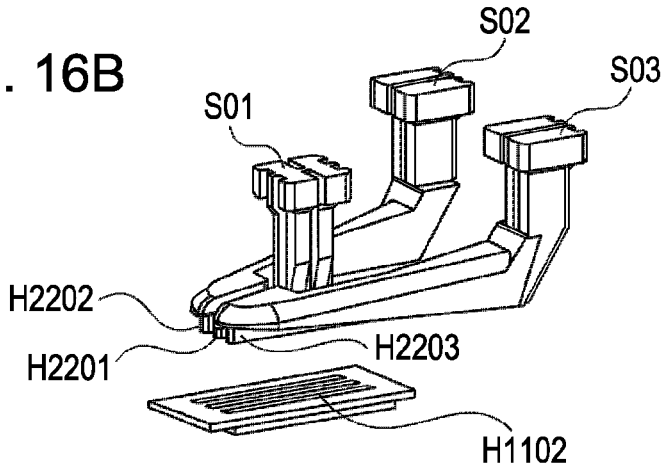
Figure 16C:
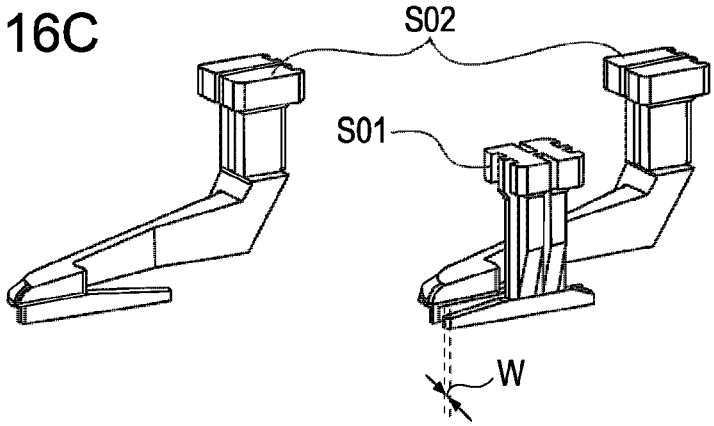
Figure 17A:
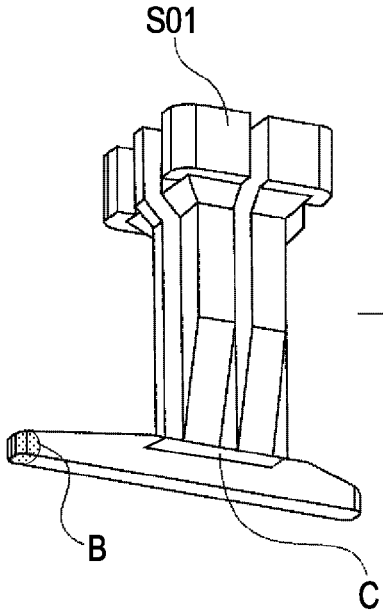
FIGS. 17A through 17F are schematic diagrams for describing the generation and growth of bubbles in ink supply paths.
Figure 17B:
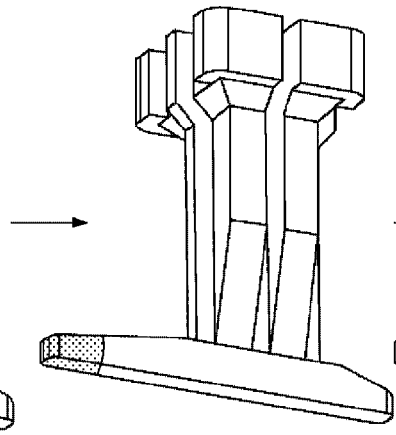
Figure 17C:
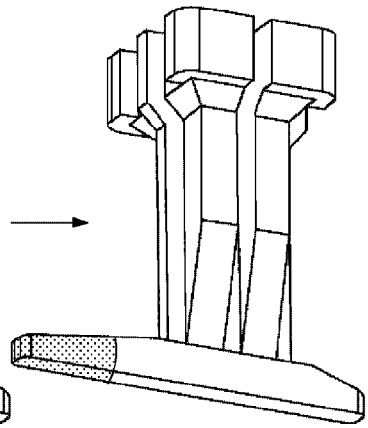
Figure 17D:
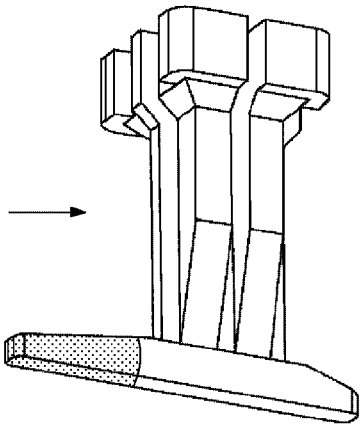
Figure 17E:
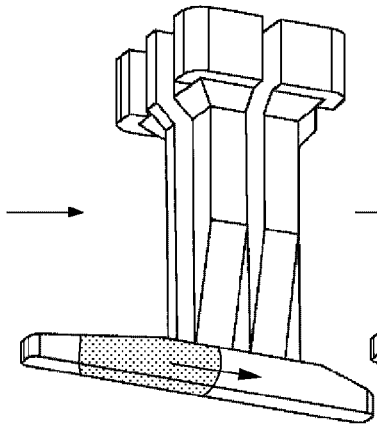
Figure 17F:
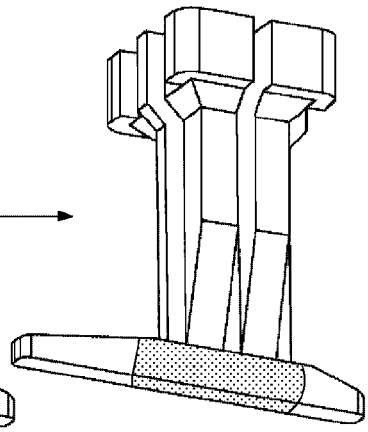

In this specification, the ink supply path is configured such that ink communicates through the connected portion between the ink introduction passage and the liquid chamber and that the ink introduction passage is located vertically above (in the z-direction) of the liquid chamber during use of the recording head, stated differently, in a state in which the recording head is mounted to a recording apparatus (See FIG. 13). A vertical cross section of the liquid chamber is an elongated shape, and the length direction of the elongated shape is defined as an x-direction and the width direction thereof is defined as a y-direction.

The behavior of bubbles that are shorter than the length Cx of the communicating portion C in the x-direction after generated in the liquid chamber until going therethrough to the ink introduction passage will be described with reference to FIGS. 1A to 1C.

Figure 1A:
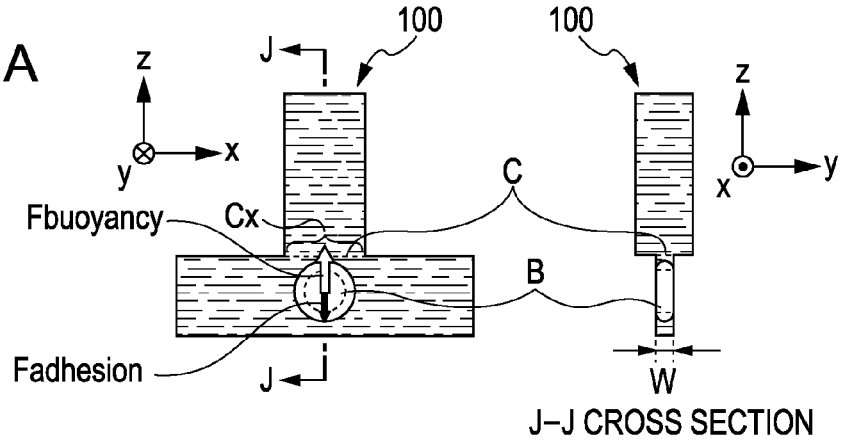
FIGS. 1A through 1E are diagrams for describing the behavior of bubbles in an ink supply path.

As shown in a J-J cross section in FIG. 1A, in the case where bubbles are sandwiched between the walls of the liquid chamber into a flat shape because the liquid-chamber width W of an ink supply path 100 is narrow, the cross section of the end of the bubbles B that are not in contact with the walls of the liquid chamber is expected to form a substantially semicircular shape, the curvature radius rb of which seems to depend on the liquid-chamber width W (the length in the y-direction). Accordingly, the curvature radius rb of the cross section of the end of the bubbles B can be approximated to W/2 (FIG. 1C). This will be described later in detail.

Next, a force applied to the bubbles B will be described. The bubbles B are acted on by buoyancy, Fbuoyancy, vertically upward (in the z-direction) due to the difference in density between liquid and gas and by a force, vertically downward, that prevents the movement of the bubbles B. The force that prevents the movement of the bubbles B is caused by the contact of the bubbles B with the walls of the liquid chamber. This force is referred to as adhesive force, Fadhesion. The adhesive force Fadhesion seems to depend on the surface tension of liquid, the liquid-chamber width W, and the contact area between the bubbles B and the walls of the liquid chamber. That is, the adhesive force Fadhesion is expected to increase when the surface tension of the liquid is large, when the width W of the liquid chamber is small, and when the contact area is large.

Figure 1B:
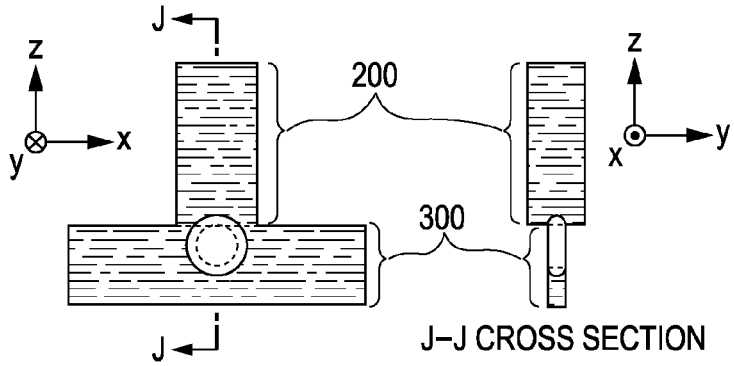
Figure 1C:
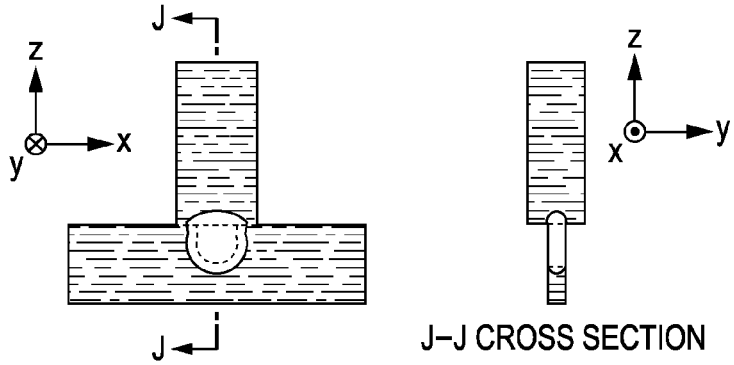

If the only the buoyancy Fbuoyancy and adhesive force Fadhesion are applied to the bubbles B and Fbuoyancy>Fadhesion, for example, the bubbles B located at the position shown in FIG. 1A move upward in a liquid chamber 300 (FIG. 1B). The part (hereinafter referred to as a bubble adhering portion) of the bubbles B that is in contact with the walls of the liquid chamber 300 reaches the communicating portion C (FIG. 1B). When the bubble adhering portion reaches the communicating portion C, the bubbles B communicate through the communicating portion C into an ink introduction passage 200 that is larger in width in the y-direction than the liquid chamber 300 (FIG. 1C). Since the bubbles B in the liquid chamber 300 are decreased by an amount corresponding to the movement to the ink introduction passage 200, thus reducing the adhering portion, the adhesive force is expected to be reduced while the buoyancy Fbuoyancy is maintained. Accordingly, once the bubbles B start to communicate, the bubbles B can move toward the ink introduction passage 200 in a shorter time than during moving in the liquid chamber 300. The bubbles B are expected to continue to move toward the ink introduction passage 200 without being separated until the buoyancy of the bubbles B in the ink introduction passage 200 becomes larger than the adhesive force in the liquid chamber 300. Whether the bubbles B in the ink introduction passage 200 are separated from the bubbles B in the liquid chamber 300 seems to depend on the size of the bubbles B.

As described above, since the bubbles B are in contact with the walls of the liquid chamber 300, when the bubbles B move upward due to the buoyancy in the liquid chamber 300, adhesive force in addition to the buoyancy is applied to the bubbles B. Accordingly, unless vibrations or the like are applied to the liquid chamber 300, the bubbles B having many adhering portions on the walls of the liquid chamber 300 can move only at a significantly slow speed.

When the bubbles B are generated and grown in the liquid chamber 300, the influence of the bubbles B on recording is large because the ratio of the volume of the liquid chamber 300 to the volume of the bubbles B is high and the liquid chamber 300 is close to the ink supply port. Accordingly, it is important to move the bubbles B from the liquid chamber 300 to the ink introduction passage 200.

Figures 1D, 1E:
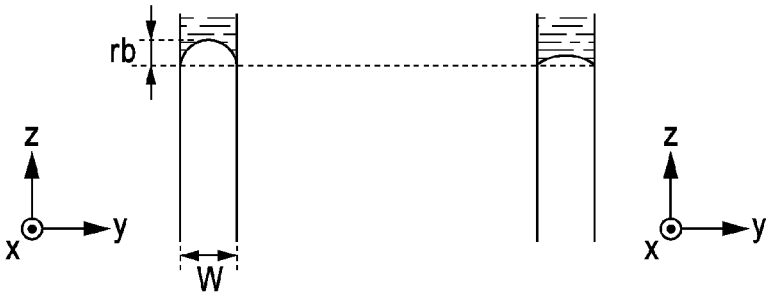

Here, the reason why the curvature radius rb can be approximated to W/2 will be described with reference to FIG. 1D. The bubbles B move upward in the liquid chamber 300 that is wet with liquid such as ink. Thus, at least the adhering portion of the bubbles B in the moving direction seems to be wet with the liquid. In other words, the bubbles B are in contact with the walls of the liquid chamber 300 with thin liquid film therebetween.

In the case where the walls, in contact with the bubbles B, of the liquid chamber 300 are wet, the end of the bubbles B forms a free curved surface, so that the cross section of the end of the bubbles B on a surface perpendicular to the x-direction forms a semicircular shape, and therefore the curvature radius rb of the cross section of the end of the bubbles B can be approximated to W/2. As shown in FIG. 1E, in the case where the walls, in contact with the bubbles B, of the liquid chamber 300 are not wet (the bubbles B are in direct contact with the walls of the liquid chamber 300), the shape of the cross section of the end of the bubbles B depends on the surface tension of the liquid and the width W of the liquid chamber 300. In this case, the curvature radius of the cross section of the end of the bubbles B is larger than the curvature radius rb, so that the end of the bubbles B (the part of the bubbles B that is not in contact with the walls of the liquid chamber 300) is smaller than that when the walls of the liquid chamber 300 are wet (FIG. 1D). Even with the same adhering portions, the adhesive force is large when the walls of the liquid chamber 300 are not wet than when wet, so that the bubbles B are expected to be hardly peeled off from the walls of the liquid chamber 300.

How the bubbles B generated in the liquid chamber 300 behave in the communicating portion C has been described above. Then, the behavior of bubbles having a length longer in the x-direction than the length Cx of the communicating portion C when reaching the communicating portion C will be described by comparison between the configuration of an embodiment of the present invention and the configuration of a comparative example.

Figure 2A:
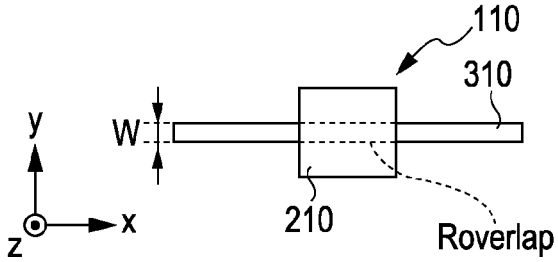
FIGS. 2A through 2C are diagrams for describing the behavior of bubbles in an ink supply path according to an embodiment of the present invention.
Figure 2B:
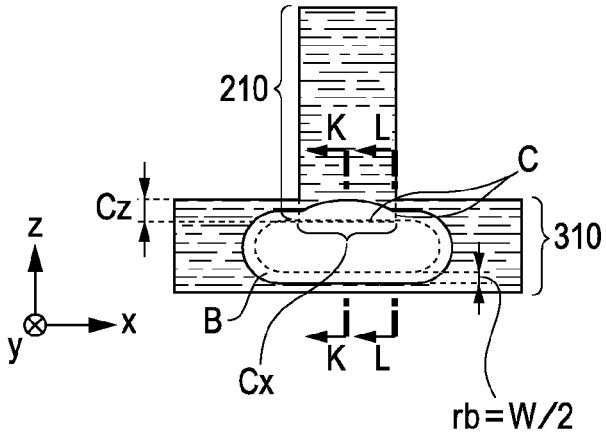
Figure 2C:
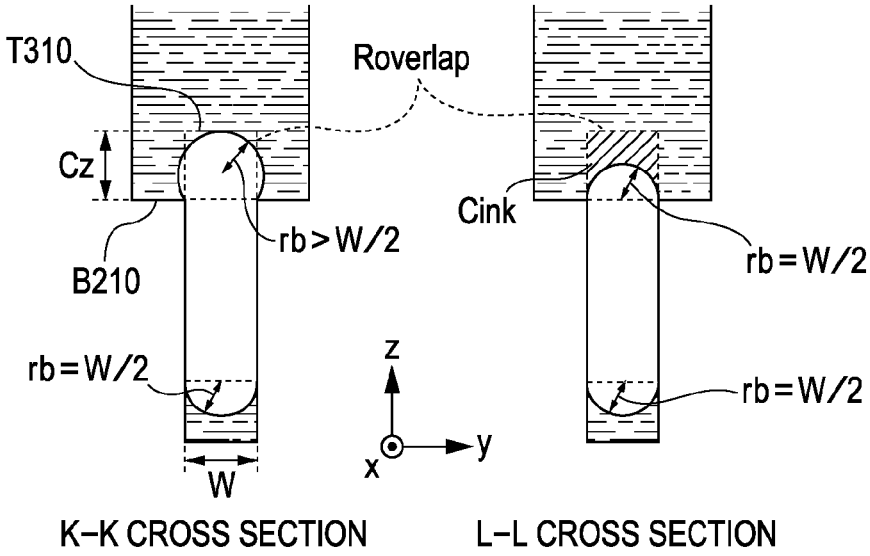
Figure 3A:
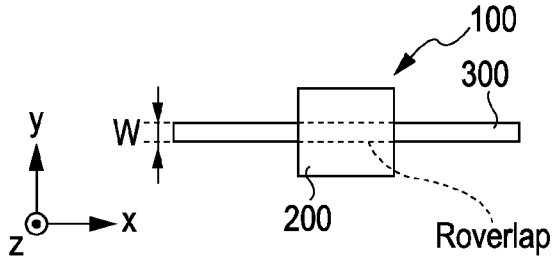
FIGS. 3A through 3C are diagrams for describing the behavior of bubbles in an ink supply path of a comparative example.
Figure 3B:
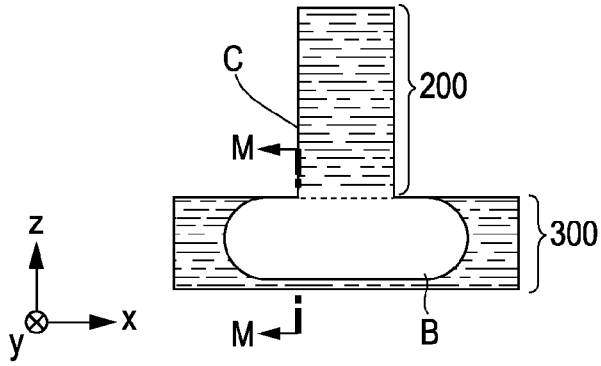
Figure 3C:
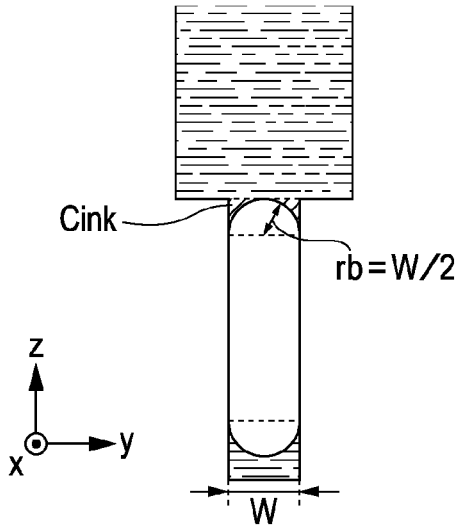

FIGS. 2A to 2C show an ink supply path 110 as an example of the present invention, and FIGS. 3A to 3C show the ink supply path 100 as a comparative example. FIGS. 2A and 3A are projection drawings as viewed from the z-direction, and FIGS. 2B and 3B are projection drawings as viewed from the y-direction. FIG. 2C shows a K-K cross section and an L-L cross section (a plane including the y-axis and the z-axis) of FIG. 2B, and FIG. 3C shows an M-M cross section (a plane including the y-axis and the z-axis) of FIG. 3B. A boundary that increases in width in the y-direction from the liquid chamber to the ink introduction passage is referred to as a communicating portion C. The communicating portion C is projecting from the liquid introduction passage for the liquid chamber. The communicating portion C is indicated by a dotted line.

As shown in FIGS. 2A and 2B, configurations as prerequisites of the present invention are that the relation between an ink introduction passage 210 and a liquid chamber 310 holds (1), for the x-direction, the length of the liquid chamber>the length Cx of the ink introduction passage at the communicating portion C>the width W of the liquid chamber and (2) for the y-direction, the length of the ink introduction passage>the length of the liquid chamber (the liquid-chamber width W) at the communicating portion C.

The relational expression of the left side and the middle side of (1) indicates a case in which the problem of the present invention that the ink flow is prone to be blocked at the communicating portion C by the bubbles B occurs. Satisfying the relational expression between the middle side and the right side of (1) and the relational expression (2) provides a configuration in which the bubbles B can easily move in the ink introduction passage than in the liquid chamber by increasing at least the lengths of the ink introduction passage in the x-direction and the y-direction than the liquid-chamber width W as much as possible. The ink introduction passage has only to have lengths in the x-direction and the y-direction so as not to prevent the expansion of the bubbles B in the ink introduction passage when the bubbles B move to the ink introduction passage through the communicating portion C. Accordingly, the ink introduction passage may be configured to increase in length in the x-direction and the y-direction vertically upward from the communicating portion C.

Next, the difference between the present invention and the comparative example will be specifically described.

Both of the present invention (FIGS. 2A to 2C) and the comparative example (FIGS. 3A to 3C) have an overlapping area Roverlap (FIGS. 2A and 3A) at the communicating portion C when the ink introduction passage is viewed from the z-direction. In contrast, when viewed from the x-direction, the present invention has the overlapping area Roverlap (FIG. 2C) of the communicating portion C, whereas the comparative example (FIG. 3C) has no overlapping area Roverlap of the communicating portion C. In other words, in the present invention, a top T310 of the liquid chamber 310 is located vertically above a bottom B210 of the ink introduction passage 210.

Because of such a difference in configuration, there are the following differences between the present invention and the comparative example when the bubbles B with a width larger than the length Cx of the ink introduction passage at the communicating portion C in the x-direction reach the communicating portion C, for example, from below in the vertical direction:

With the configuration of the comparative example, as shown in FIG. 3B, of the bubbles B that have moved to the top of the liquid chamber 300, the bubbles B that have protruded in the x-direction from the communicating portion C receive a vertical drag from the walls at the top of the liquid chamber 300. The force applied to the bubbles B in this state includes buoyancy in a vertically upward direction and adhesive force and vertical drag in the vertically downward direction, which are balanced. Accordingly, with the configuration of the comparative example, the bubbles B stay in the vicinity of the communicating portion C, thus making it difficult to move the bubbles B to the ink introduction passage 200 through the communicating portion C.

In contrast, with the configuration of the present invention, as shown in FIG. 2B, when the bubbles B move upward from vertically below toward the communicating portion C, the bubble adhering portion reaches the communicating portion C to start communication of the bubbles B. When the bubbles B start to communicate, the bubbles B in the liquid chamber 310 do not rise to the top of the liquid chamber 310 but the bubbles B in the ink introduction passage 210 rise while expanding. Accordingly, the configuration of the present invention allows communication of the bubbles B to be induced even if bubbles B longer than Cx reach the communicating portion C. When comparing an ink communicating portion Cink of the L-L cross section in FIG. 2C and an ink communicating portion Cink of the M-M cross section in FIG. 3C, the area of the ink communicating portions Cink in the present invention is larger than that of the comparative example. Therefore, the ink flow in the communicating portion C is more with the configuration of the present invention than with the configuration of the comparative example. Thus, as conditions for accelerating communication of the bubbles B through the communicating portion C, it is necessary to satisfy Cz>rb, where Cz is the z-direction length of the projection plane of the communicating portion C as viewed from the x-direction, which is the distance between the top T310 of the liquid chamber 310 and the bottom B210 of the ink introduction passage 210, and rb is the curvature radius of the end of the bubbles B. Since the curvature radius rb of the end of the bubbles B can be approximated to W/2, as described above, it is sufficient to satisfy Cz>rb=W/2. That is, by setting Cz larger than half of the liquid-chamber width W, the bubbles B can easily communicate through the communicating portion C so as to easily move from the liquid chamber to the ink introduction passage, and a fixed amount of ink flow can be ensured while the bubbles B is communicating.

A case in which the liquid chamber is configured such that vertically upward wall surfaces (in the z-direction) have inclined surfaces that incline in the x-direction from the ends of the liquid chamber toward the ink introduction passage will be described by comparing the configuration of the present invention in FIG. 4A and comparative examples A and B in FIGS. 4B and 4C.

Figure 4A:
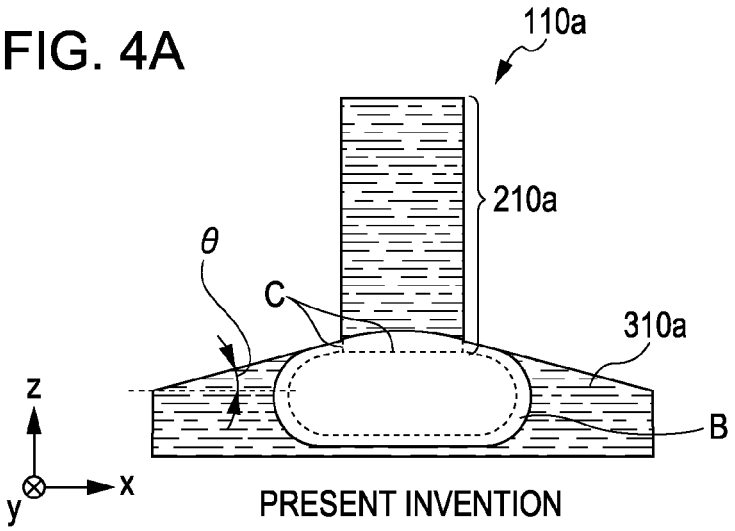
FIG. 4A is a diagram showing an ink supply path according to an embodiment of the present invention in which the liquid chamber has inclined surfaces.
Figure 4B:
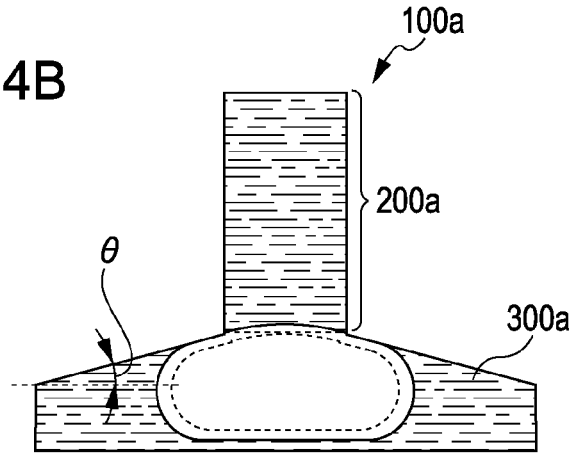
FIGS. 4B and 4C are diagrams showing ink supply paths of comparative examples in which the liquid chambers have inclined surfaces.
Figure 4C:
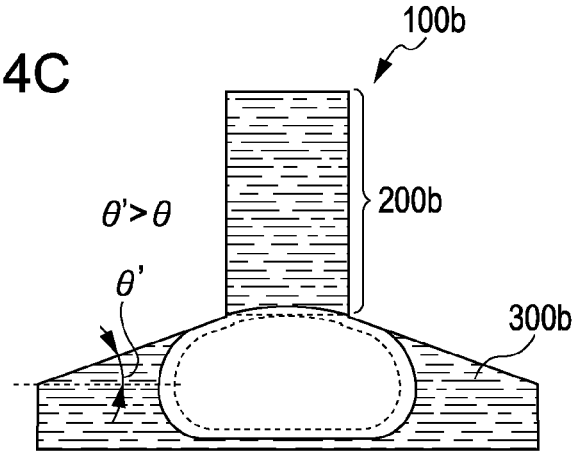

In an ink supply path 110*a* constituted by an ink introduction passage 210*a* and a liquid chamber 310*a* shown in FIG. 4A, even if the bubbles B reach the communicating portion C along the inclined surfaces, as shown in the drawing, the advantages of the present invention can be offered provided that the relation Cz>W/2 is satisfied. That is, since the bubbles B are along the inclined surfaces at an inclination angle θ, as shown in FIG. 4A, the top of the bubbles B can protrude to the ink introduction passage 210*a*. In this case, at least the top of the adhering portion of the bubbles B can communicate with the ink introduction passage 210*a* along a surface (a projection surface in the vertical direction) perpendicular to the vertical direction of the communicating portion C. On the other hand, as shown in FIG. 4B, with the configuration of an ink supply path 100*a* of the comparative example A, in which the x-direction length of an ink introduction passage 200*a* and a liquid chamber 300*a* form an inclination angle θ, the top of the adhering portion of the bubbles B cannot always reach the ink supply path 100*a* although the top of the bubbles B can protrude to the ink introduction passage 200*a*. To make the bubbles B communicate in the configuration of the comparative example A, it is necessary to set the inclination angle to θ' larger than θ in the comparative example A, like an ink supply path 100*b* constituted by an ink introduction passage 200*b* and a liquid chamber 300*b* in the comparative example B, shown in FIG. 4C, which has a great design limitation.

A liquid chamber having an inclined surface may be configured such that either only one end has an inclined surface or both ends have an inclined surface. The both ends may have different inclination angles.

As described above, the use of the configuration of the present invention can decrease the influences of bubbles on recording as compared with the configuration of the comparative examples.

Embodiments of the present invention will be described hereinbelow.

A first embodiment will be described with reference to FIGS. 5A, 5B, 6A, 6B, 6C, and 10B.

As shown in FIG. 10B, this embodiment has therein ink containing portions H2011 to H2013 for holding cyan, magenta, and yellow inks, like common inkjet recording heads, and independent ink supply paths for introducing the inks into the individual ink supply ports H1102 in the recording element substrate H1101.

Figure 5A:
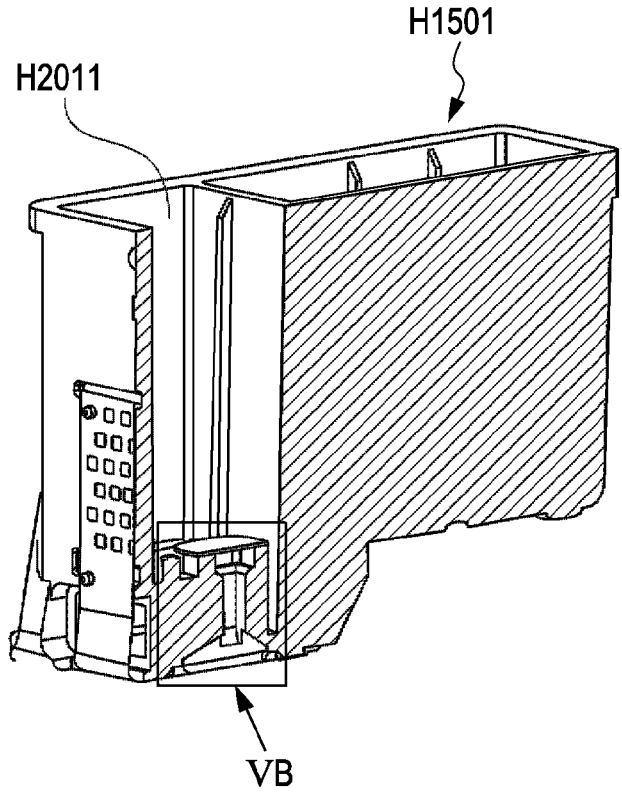
FIG. 5A is a sectional view of an ink tank of a first embodiment.

FIG. 5A is a perspective view of a cross section of the ink tank H1501 (a covering member H1901 and so on are not shown for clarification of description).

Figure 5B:
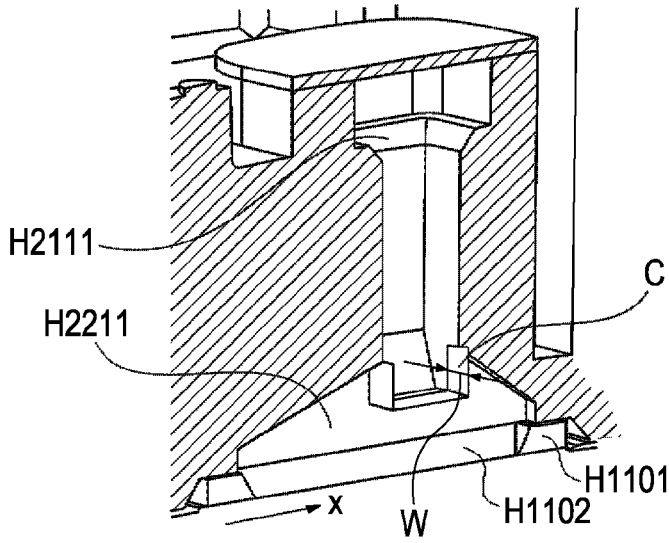
FIG. 5B is an enlarged view of an ink supply path in FIG. 5A.

FIG. 5B shows an enlarged view of a part VB in FIG. 5A to describe the shape of the ink supply path of this embodiment in detail. As shown in the drawing, the connecting portion between a liquid chamber H2211 having a given width W and an ink introduction passage H2111 that is shorter than the length of the liquid chamber H2211 and longer than the liquid-chamber width W in the x-direction is referred to as a communicating portion C. In this embodiment, the communicating portion C is constituted by one surface (including the x-axis and the y-axis) facing the ink supply port H1102 and two surfaces (perpendicular to the x-direction) perpendicular to the surface and along the width direction of the liquid chamber H2211.

Figure 6A:
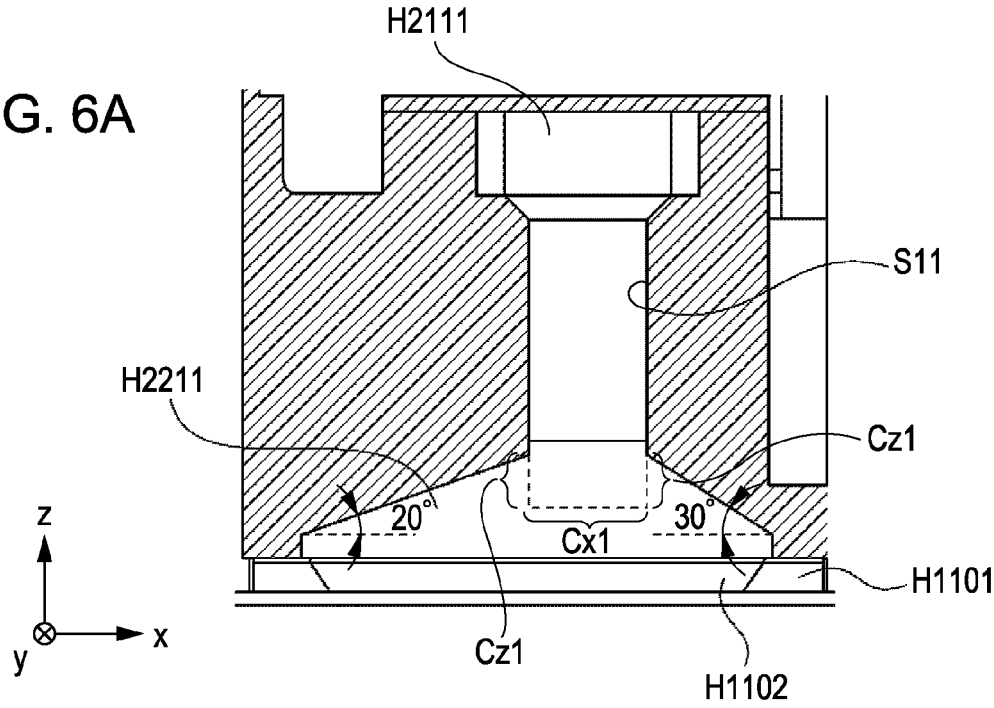
FIG. 6A is a diagram for describing an ink supply path of the first embodiment.
Figure 6B:
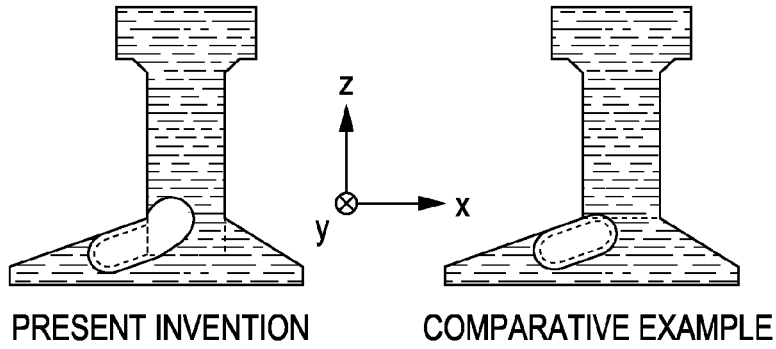
FIG. 6B is a diagram for describing the behavior of bubbles in an ink supply path by comparing the first embodiment and a comparative example.
Figure 6C:
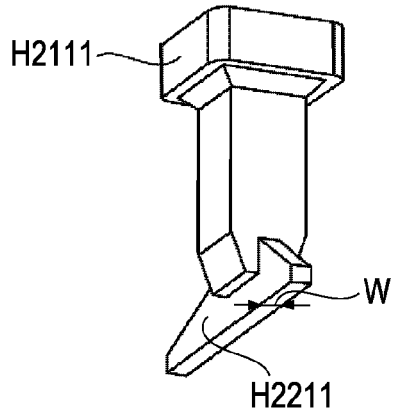
FIG. 6C is a schematic perspective view of the ink supply path shown in FIG. 6A.

FIG. 6A is a schematic sectional view of an ink supply path S11, and FIG. 6C is a schematic perspective view of the ink supply path S11. Assuming that, of the surfaces constituting the communicating portion C, the surface (horizontal surface) facing the ink supply port H1102 has a x-direction length Cx1 (3.2 mm) and the two surfaces (vertical surfaces) along the width direction of the liquid chamber H2211 has a z-direction length Cz1 (1.4 mm).

In this embodiment, the liquid chamber H2211 has inclined surfaces at an inclination angle θ so that bubbles generated at the ends of the liquid chamber H2211 can easily move to the communicating portion C.

The liquid-chamber width W in this embodiment is 0.65 mm, and thus Cz1 is determined to satisfy Cz1>0.65/2=0.325 mm.

It is also possible to set the upper ends of the two vertical surfaces of the communicating portion C (the upper ends of the liquid chamber H2211) at different heights. However, such different heights of the upper ends may sometimes cause bubbles while suction recovery is performed by sucking ink from the discharge port. Accordingly, it is desirable to set the heights of the upper ends of the vertical surfaces equal.

This embodiment will be described when the x-direction length of the bubbles that have reached the communicating portion C is shorter than the x-direction length Cx of the communicating portion C. In such a case, both the configurations of the embodiment of the present invention and a comparative example (FIG. 6B) allow the bubbles to move to the ink introduction passage through the communicating portion C. The advantages of the embodiment of the present invention when the length of the bubbles in the x-direction is longer than the x-direction length Cx of the communicating portion C are the same as those described with reference to FIG. 2.

FIG. 6B schematically shows the ink supply paths of the embodiment of the present invention and the comparative example, showing the difference therebetween. The moving distance of bubbles in the liquid chamber per unit time can be regarded as being equal provided that they have the same liquid-chamber width W and cone angle.

In the embodiment of the present invention, the communicating portion C has not only a horizontal surface but also vertical surfaces, bubbles can move to the ink introduction passage by a moving amount in the z-direction on the horizontal surface and a moving amount in the x-direction on the vertical surfaces. In contrast, in the comparative example, the communicating portion C is constituted only by the horizontal surface, the bubbles can move to the ink introduction passage by only a moving amount in the z-direction.

Furthermore, in the embodiment of the present invention, bubbles communicate with the ink introduction passage H2111 along one of the two vertical surfaces of the communicating portion C. Accordingly, an ink communication state is maintained at least on the other vertical surface or the horizontal surface until most of the bubbles move from the liquid chamber H2211 to the ink introduction passage H2111. In contrast, in the comparative example, the communicating portion C includes only the horizontal surface. Therefore, the area of communication of ink on the horizontal surface is small until bubbles communicate on the horizontal surface and most of the bubbles move to the ink introduction passage.

With the configuration described above, this embodiment has the advantage that bubbles generated in the liquid chamber easily communicate through the communicating portion C, so that they easily move from the liquid chamber to the ink introduction passage. This embodiment also has the advantage that, since bubbles communicate to the ink introduction passage along any of the surfaces constituting the communicating portion C, an ink communicating state can be maintained on the other surfaces.

Increasing the inclination angle of the inclined surface of the liquid chamber allows bubbles generated in the liquid chamber to easily move to the communicating portion C and to easily move to the ink introduction passage through the communicating portion C.

Figure 7A:
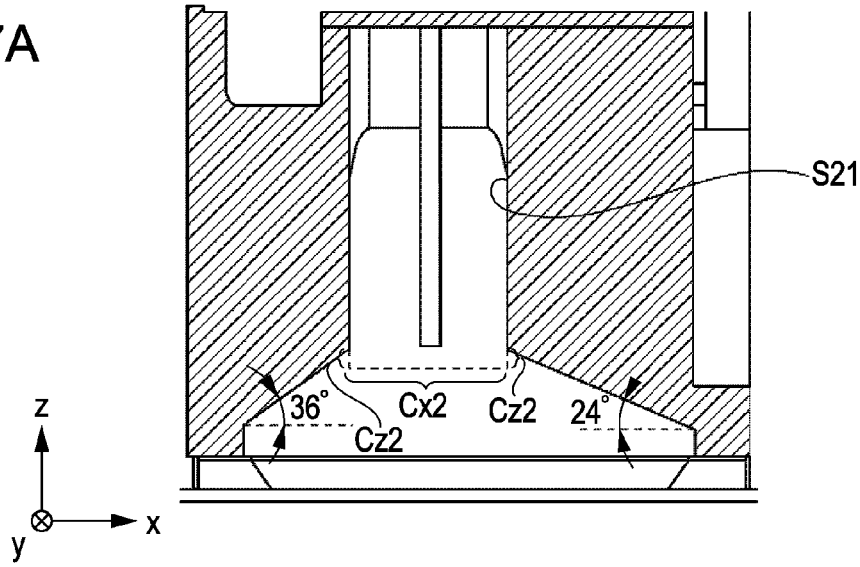
FIG. 7A is a diagram for describing an ink supply path of a second embodiment.

A second embodiment that is a modification of the first embodiment will be described with reference to FIGS. 7A to 7C.

In the second embodiment, the communicating portion C has an ink supply path S21, the height Cz of the vertical surfaces of which is shorter than that of the first embodiment. A height Cz2 shown in FIG. 7A is 0.4 mm, which is close to W/2=0.65/2 mm=0.325 mm. It was confirmed that this also has the advantages of the present invention provided that Cz>W/2 is satisfied. The length Cx2 is 3.4 mm. If the length Cx is longer than the height Cz as described above, bubbles can easily communicate along the horizontal surface of the communicating portion C.

This configuration provides the advantage that bubbles generated in the liquid chamber can easily communicate through the communicating portion C and can easily move from the liquid chamber to the ink introduction passage. Furthermore, as in the first embodiment, bubbles communicate to the ink introduction passage along any of the surfaces that constitute the communicating portion C, thus offering the advantages of allowing the ink communicating state of the other surface to be maintained.

The configuration of the inner ink supply path S21 has been described. Next, the other ink supply paths will be specifically described with reference to FIG. 7B. The ink supply paths of the first embodiment also have the same configuration as the ink supply paths to be described below.

Figure 7B:
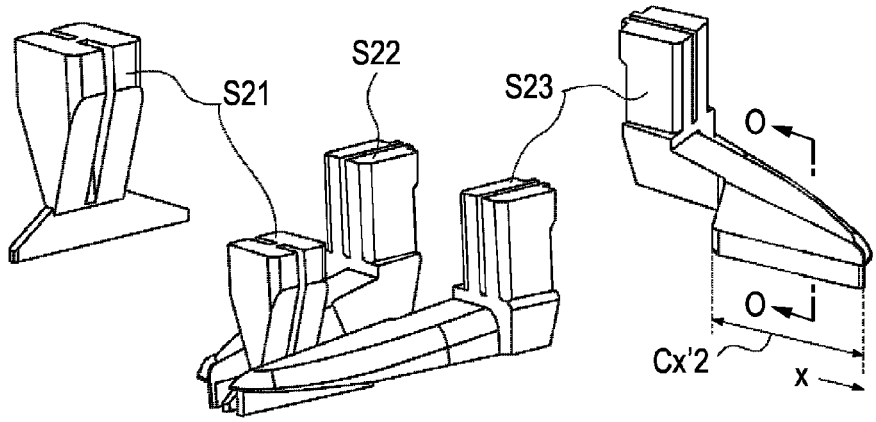
FIG. 7B is a schematic perspective view of the inner ink supply path shown in FIG. 7A and outer ink supply paths in an ink tank.
Figure 7C:
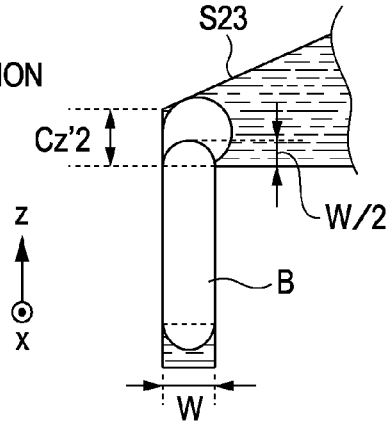
FIG. 7C is a diagram for describing the behavior of bubbles in one of the outer ink supply paths shown in FIG. 7B.

FIG. 7B shows three ink supply paths S21 to S23 disposed appropriated in the ink tank H1501 shown in FIG. 10B. The disposition of a plurality of ink supply paths allows supply of a plurality of colors of ink while preventing upsizing of the recording head.

Since an outside ink supply path has a higher degree of design flexibility than an inner ink supply path, the ink supply path S23 shown in FIG. 7B can be increased in the x-direction width Cx'2 of the communicating portion (equal to the x-direction length of the liquid chamber at the maximum). Setting the difference Cz'2 between the tops of the wall surfaces of the liquid chamber to be larger than W/2, as shown by the O-O cross section of FIG. 7B, shown in FIG. 7C, can provide a configuration in which bubbles can communicate more easily. Such a configuration allows the ink communication state to be maintained even if grown bubbles reach the communicating portion.

A third embodiment will be described with reference to FIGS. 8A, 8B, 9A, 9B, 9C, and 11.

While the first and second embodiments have been described as related to the configuration of an inkjet recording head having a recording element substrate capable of ejecting three colors of ink, the third embodiment will be described as related to a four-color inkjet recording head.

In this embodiment, ink supply paths applied to the recording head H1002 capable of ejecting four colors of ink, shown in FIG. 11, will be described. As shown in the drawing, the ink tank H1502 has therein ink containing portions H2031 to H2034 for holding cyan, magenta, yellow, and black inks. The ink supply ports in a recording element substrate (not shown) having four discharge port arrays have independent ink supply paths for introducing the inks into the individual ink supply ports.

Figure 9A:
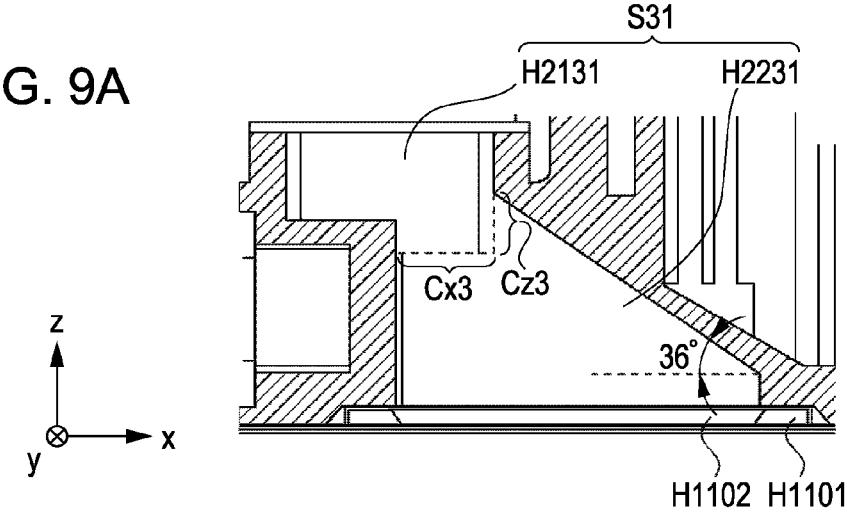
FIG. 9A is a diagram for describing an ink supply path according to the third embodiment.
Figure 9B:
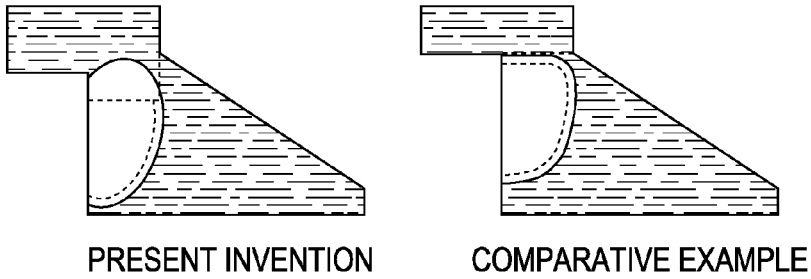
FIG. 9B is a diagram for describing the behavior of bubbles in an ink supply path by comparing the third embodiment and a comparative example.
Figure 9C:
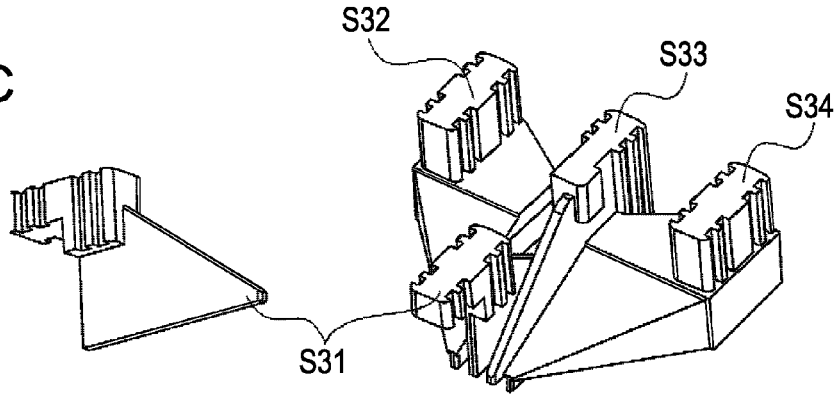
FIG. 9C is a schematic perspective view of the inner ink supply path shown in FIG. 9A and outer ink supply paths in an ink tank.

FIG. 9C shows an example in which four ink supply paths S31 to S34 are appropriately arranged in the ink tank H1502 shown in FIG. 11. The main difference between the first and second embodiments is the inner ink supply paths S31 and S33.

The configuration of the inner ink supply path S31 will be described in detail with reference to FIGS. 8A and 8B. Since the configuration of the ink supply path S33 is substantially the same and has the same advantages, a description thereof will be omitted.

Figure 8A:
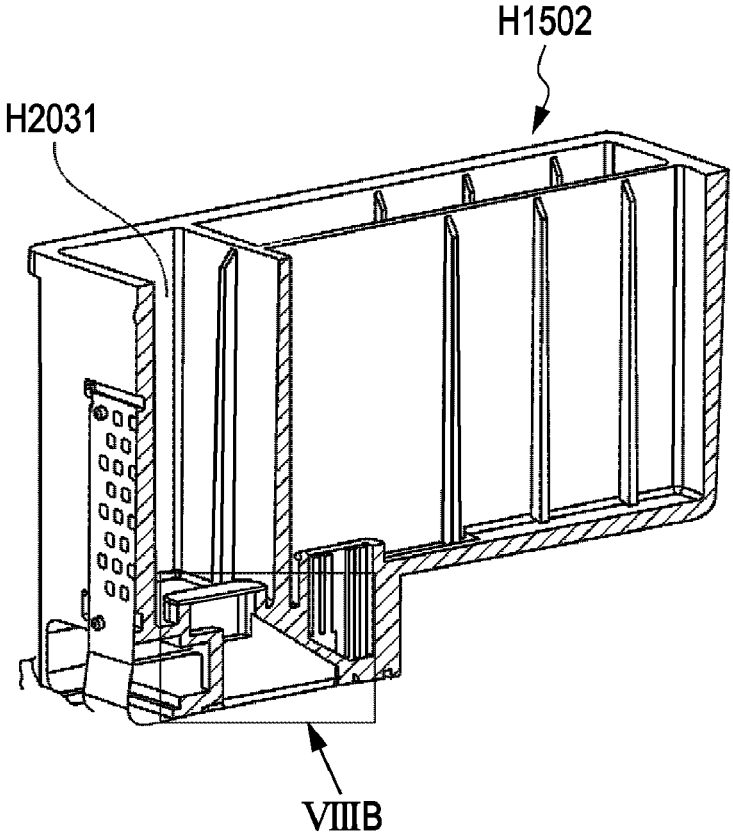
FIG. 8A is a sectional view of an ink tank according to a third embodiment.

FIG. 8A is a perspective view of a cross section of the ink tank H1502 (the covering member H1901 and so on are not shown for clarification of description).

Figure 8B:
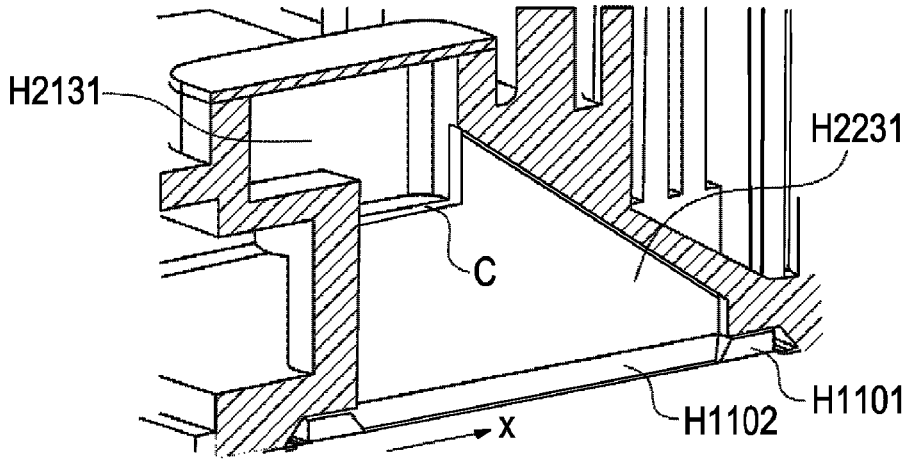
FIG. 8B is an enlarged view of an ink supply path in FIG. 8A.

FIG. 8B is an enlarged view of a part VIIIB in FIG. 8A to describe in detail the shape of the ink supply path of this embodiment. As shown in the drawing, the communicating portion C of this embodiment is constituted by two surfaces, that is a horizontal surface and a vertical surface. As shown in FIG. 9A, the ink supply path S31 is constituted by an ink introduction passage H2131 and a liquid chamber H2231. Suppose that the x-direction length of the horizontal surface of the communicating portion C, described above, is Cx3 (3.1 mm), and the z-direction length of the vertical surface is Cz3 (1.4 mm).

For example, if bubbles are generated at the position shown in FIG. 9B, the bubbles that have reached the communicating portion C communicate with the ink introduction passage along the horizontal surface. At that time, the configuration of the embodiment of the present invention allows an ink communicating state to be maintained on the vertical surface while the bubbles communicate along the horizontal surface. If the bubbles communicate along the vertical surface, the ink communicating state can be maintained on the horizontal surface. In contrast, in the comparative example, when bubbles reaches the communicating portion C constituted only by the horizontal surface, little ink communicates while the bubbles are communicating along the horizontal surface.

Since this embodiment is configured such that the inclination angle of the inclined surface of the liquid chamber can easily be increased as compared with the configurations of the first and second embodiments, the speed at which bubbles move in the z-direction in the liquid chamber can be increased, thus making the bubbles easily reach the communicating portion C.

Even if the z-direction length Cz3 of the vertical surface is short, the same advantages as the second embodiment can be offered provided that Cz3>W/2 is satisfied.

As described above, even if the communicating portion C is constituted by two surfaces, bubbles can easily communicate through the communicating portion C, as in the first and second embodiments, and furthermore, an ink communicating state can be maintained on at least one surface.

Although the first to third embodiments have been described taking a vertical surface and a horizontal surface as surfaces that constitute the communicating portion C, surfaces to which the ink introduction passage and the liquid chamber connect may not necessarily be vertical or horizontal. Surfaces that constitute the communicating portion C may be two or more. That is, it is sufficient that the communicating portion C have a projection plane viewed from the x-direction and a projection plane viewed from the x-direction, and the z-direction length of the projection plane viewed from the x-direction is larger than ½ of the liquid-chamber width W.

Although bubbles that have passed through the communicating portion C are stored in the ink introduction passage, the bubbles stored in that part can sometimes hardly be removed by suction recovery. Accordingly, it is preferable that the ink introduction passage have a sufficient volume not to affect on recording.

Recording Apparatus

FIG. 13 is a schematic top view of an example of a recording apparatus on which the recording head according to an embodiment of the present invention can be mounted, showing the interior thereof.

As shown in FIG. 13, this recording apparatus has a carriage 102 on which the recording heads shown in FIGS. 10A, 10B, and 11 are located and replaceably mounted.

The carriage 102 has an electrically connecting portion for transferring electrical signals and so on to the individual electrothermal converters through the external-signal input terminals H1302 (FIGS. 10B and 11) provided on the individual electrical wiring sheets H1301 (FIGS. 10B and 11) that constitute the individual recording heads.

The carriage 102 also has mounting guide rails (not shown) corresponding to cover guides H1902 (FIGS. 10B and 11) provided at the covering member H1901. The recording heads can be mounted, along the mounting guide rails, on the carriage 102 by supporting the cover guides H1902 by the mounting guide rails. The ink tanks that constitute the individual recording heads each have mounting guides H1560 (FIGS. 10B and 11) for guiding the recording heads to the head mounting positions of the carriage 102.

The recording heads H1001 and H1002 are guided to predetermined positions of the carriage 102 by the mounting guides H1560 and the cover guides H1902, described above, and fixed thereto by engaging portions H1930 (FIGS. 10B and 11) and so on for fixing the recording heads H1001 and H1002 to the recording apparatus.

The carriage 102 is supported along guide shafts 103 extending in the main scanning direction on the apparatus main body so as to reciprocate. The recording heads H1001 and H1002 are mounted on the carriage 102 such that the arranging direction of the discharge ports (the direction along the discharge port arrays) crosses the scanning direction of the carriage 102. The recording heads H1001 and H1002 eject liquid from the discharge port arrays onto a recording medium 108 conveyed to a position facing the discharge ports by pickup rollers 131 and a conveying roller 109 serving as conveying devices for the recording medium 108.

Reference numeral 101 denotes a recovery mechanism, which has a cap member for use in protecting the discharge-port formed surfaces of the recording heads H1001 and H1002 and sucks ink from the discharge ports of the recording heads H1001 and H1002 to recover the recording heads H1001 and H1002 to an ejectable state. The cap member can be set at joined and separated positions to/from the discharge-port formed surface by a motor (not shown). In the joined state, a negative pressure is generated inside the cap member by a suction pump or the like (not shown) so that recording-head suction-recovery operation is performed. Also while the recording apparatus is not in use, the discharge-port formed surfaces of the recording heads H1001 and H1002 can be protected by setting the cap member in its joined state.

Although an example of a recording apparatus is shown in which the recording heads H1001 and H1002 are detachably mounted on the carriage 102, a recording element substrate that constitutes a recording head and the carriage 102 may be integrated, and only an ink tank may be detachably mounted.

The recording heads according to the embodiments of the present invention may be applied to common printers that eject ink for printing, copying machines, facsimile machines having a communication system, and multifunctional recording apparatuses having the functions of such machines. Furthermore, the recording heads according to the embodiments of the present invention may be applied to apparatuses that eject liquid other than ink to draw figures or patterns on a recording medium.

While the present invention has been described with reference to exemplary embodiments, it is to be understood that the invention is not limited to the disclosed exemplary embodiments. The scope of the following claims is to be accorded the broadest interpretation so as to encompass all modifications and equivalent structures and functions.

This application claims the benefit of Japanese Patent Application No. 2008-095127 filed on Apr. 1, 2008, which is hereby incorporated by reference herein in its entirety.

What is claimed is:

1. A liquid discharge head mountable to a recording apparatus, the head comprising:

a discharge port array having a plurality of discharge ports configured to discharge liquid;

a liquid chamber configured to supply liquid to the discharge port array, wherein a cross section vertical to a vertical direction of the liquid chamber has an elongated shape of which a length direction is along the discharge port array, in a state in which the head is mounted to the apparatus; and a liquid introduction passage configured to introduce liquid to the liquid chamber, the liquid introduction passage being wider than the liquid chamber in a width direction of the elongated shape, wherein a communicating portion in which the liquid chamber communicates with the liquid introduction passage is longer than a width of the liquid chamber along the width direction and shorter than the liquid chamber, with respect to the length direction, and is projecting from the liquid introduction passage for the liquid chamber, and wherein with respect to a vertical direction in the state, a bottom of the liquid introduction passage is disposed at a lower position than a top of the liquid chamber in the communicating portion, and a distance between the top and the bottom is longer than half of the width of the liquid chamber.

2. The liquid discharge head according to claim 1, wherein the communicating portion comprises two or more surfaces.

3. The liquid discharge head according to claim 2, wherein the surfaces are along a surface perpendicular to the length direction.

4. The liquid discharge head according to claim 2, wherein the surfaces are along a horizontal surface in the state.

5. The liquid discharge head according to claim 1, wherein the liquid chamber has a constant width in the width direction.

6. The liquid discharge head according to claim 1, wherein an upper portion of the liquid chamber has an inclined surface upward-inclined toward the liquid introduction passage in the state.

7. A recording apparatus comprising the liquid discharge head according to claim 1 and a conveying unit configured to convey a recording medium, wherein the liquid discharge head discharges liquid to record on the recording medium.

* * * * *